US007639956B2

(12) United States Patent
Naito et al.

(10) Patent No.: US 7,639,956 B2
(45) Date of Patent: Dec. 29, 2009

(54) IMAGE FORMING APPARATUS, CARTRIDGE, AND STORING DEVICE MOUNTED TO THE CARTRIDGE

(75) Inventors: Norihito Naito, Numazu (JP); Kazumi Yamauchi, Shizuoka-ken (JP); Yasunao Otomo, Mishima (JP); Hideaki Hasegawa, Meridian, ID (US); Nobuo Oshima, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 10/528,238

(22) PCT Filed: May 14, 2004

(86) PCT No.: PCT/JP2004/006918

§ 371 (c)(1),
(2), (4) Date: Nov. 18, 2005

(87) PCT Pub. No.: WO2004/102283

PCT Pub. Date: Nov. 25, 2004

(65) Prior Publication Data

US 2006/0109491 A1 May 25, 2006

(30) Foreign Application Priority Data

May 14, 2003 (JP) ..... 2003-135766

(51) Int. Cl.
*G03G 15/00* (2006.01)

(52) U.S. Cl. ..... 399/26; 399/27; 399/51; 399/53; 399/55; 399/58

(58) Field of Classification Search ..... 399/26–27, 399/51, 53, 55, 58
See application file for complete search history.

(56) References Cited

U.S. PATENT DOCUMENTS 5,581,358 A * 12/1996 Seto et al. ..... 358/3.24

(Continued)

FOREIGN PATENT DOCUMENTS

EP 0 587 187 A1 3/1994

(Continued)

OTHER PUBLICATIONS

Russian Office Action in Appln. No. 2005138855/28(043355) and English translation thereof.

(Continued)

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

An image forming apparatus has a first image formation mode for forming an image on an image bearing member by using developer under a first predetermined image forming condition and a second image formation mode for forming an image on an image bearing member by using developer under a second image forming condition which is different from the first predetermined image forming condition and is set so that an amount of consumption of developer with respect to an identical image in the second image formation mode is smaller than that in the first image formation mode, the apparatus includes storing means for storing information on an amount of usage of the image bearing member, and control means for changing the second image forming condition in the second image formation mode depending on the information stored in the storing means.

9 Claims, 28 Drawing Sheets

U.S. PATENT DOCUMENTS

| | | | | |
|---|---|---|---|---|
| 5,583,621 | A | 12/1996 | Narukawa | 355/246 |
| 5,661,564 | A * | 8/1997 | Tomida et al. | 358/296 |
| 5,835,233 | A * | 11/1998 | Otsu et al. | 358/3.27 |
| 5,960,232 | A | 9/1999 | Cheng | 399/55 |
| 6,266,153 | B1 * | 7/2001 | Davidson et al. | 358/1.9 |
| 6,324,356 | B1 | 11/2001 | Inoue | 399/39 |
| 6,349,184 | B2 | 2/2002 | Otomo | 399/27 |
| 6,549,223 | B2 | 4/2003 | Yamauchi | 347/132 |
| 6,615,001 | B2 | 9/2003 | Otomo et al. | 399/27 |
| 6,621,989 | B2 | 9/2003 | Otomo et al. | 399/27 |
| 6,661,980 | B2 | 12/2003 | Matsumoto et al. | 399/27 |
| 6,674,975 | B2 | 1/2004 | Yamauchi | 399/12 |
| 6,785,479 | B2 | 8/2004 | Naito et al. | 399/27 |
| 6,791,714 | B1 * | 9/2004 | Ishimura | 358/1.9 |
| 6,850,714 | B2 | 2/2005 | Sakurai et al. | 399/25 |
| 6,975,428 | B1 * | 12/2005 | Ernst et al. | 358/1.9 |
| 7,062,190 | B2 * | 6/2006 | Miyamoto | 399/81 |
| 7,274,884 | B2 * | 9/2007 | Yamauchi | 399/25 |
| 2002/0044786 | A1 | 4/2002 | Kato | 399/49 |
| 2002/0071689 | A1 * | 6/2002 | Miyamoto | 399/53 |
| 2003/0165344 | A1 | 9/2003 | Ohtomo et al. | 399/27 |
| 2004/0131370 | A1 | 7/2004 | Yamauchi | 399/24 |
| 2004/0131393 | A1 | 7/2004 | Otomo et al. | 399/274 |

FOREIGN PATENT DOCUMENTS

| | | |
|---|---|---|
| JP | 11-33075 | 5/1989 |
| JP | 9-85993 A | 3/1997 |
| RU | 2 029 329 C1 | 2/1995 |

OTHER PUBLICATIONS

Sep. 3, 2007 Russian Decision on Grant in Appin. No. 2005138855/28(043355) and English translation thereof.

Dec. 13, 2007 Office Action for corresponding Vietnamese Application No. 1-2005-01831.

* cited by examiner

| DRUM USAGE | REFERENCE EMISSION TIME |
|---|---|
| 0 | 63nsec |
| 37750 | 68nsec |
| 75500 | 73nsec |
| 113250 | 78nsec |
| 151000 | 84nsec |
| 181200 | - |

FIG. 13

| LOW CONSUMPTION MODE | DRUM USAGE | REFERENCE EMISSION TIME |
|---|---|---|
| MODE 1 | 0 | 63nsec |
| MODE 2 | 37750 | 68nsec |
| MODE 3 | 75500 | 73nsec |
| MODE 4 | 113250 | 78nsec |
| MODE 5 | 151000 | 84nsec |
| MODE 6 | 181200 | - |

FIG. 14

| DRUM USAGE | LASER EMISSION TIME | PROPORTION TO REF. EMISSION TIME |
|---|---|---|
| 0 | 28nsec | 80% |
| 37750 | 28nsec | 80% |
| 75500 | 32nsec | 83% |
| 113250 | 36nsec | 85% |
| 151000 | 40nsec | 88% |
| 181200 | 44nsec | 90% |

FIG. 17

| MODE | DRUM USAGE | LINE IMAGE | SOLID BLACK IMAGE |
|---|---|---|---|
| MODE 1 | 0 | 80% | 60% |
| MODE 2 | 105700 | 83% | 65% |
| MODE 3 | 120800 | 85% | 70% |
| MODE 4 | 135900 | 88% | 75% |
| MODE 5 | 151000 | 90% | 80% |
| MODE 6 | 166100 | - | - |

FIG. 18

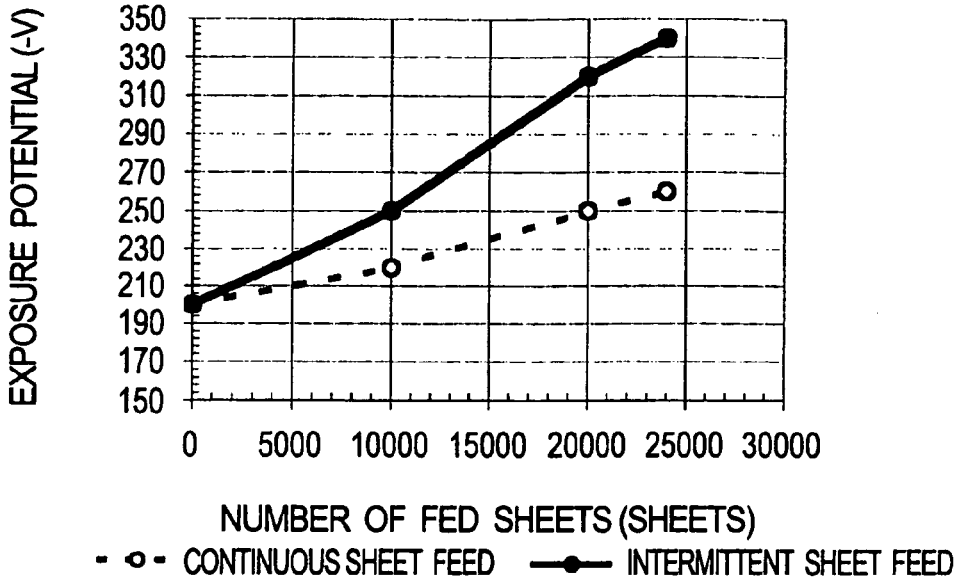
FIG.21
| | APPLICATION TIME | | | | CONTINUOUS TIME | INTERMIT-TENT TIME |
|---|---|---|---|---|---|---|
| | PRE-ROTATION | SHEET FEED | POST-ROTATION | SHEET INTERVAL | | |
| Pt | 2.0 | 1.7 | 2.0 | 1.0 | 2.7 | 5.7 |
| Dt | 2.5 | 1.7 | 2.5 | 1.0 | 2.7 | 6.7 |
(sec)
FIG.22
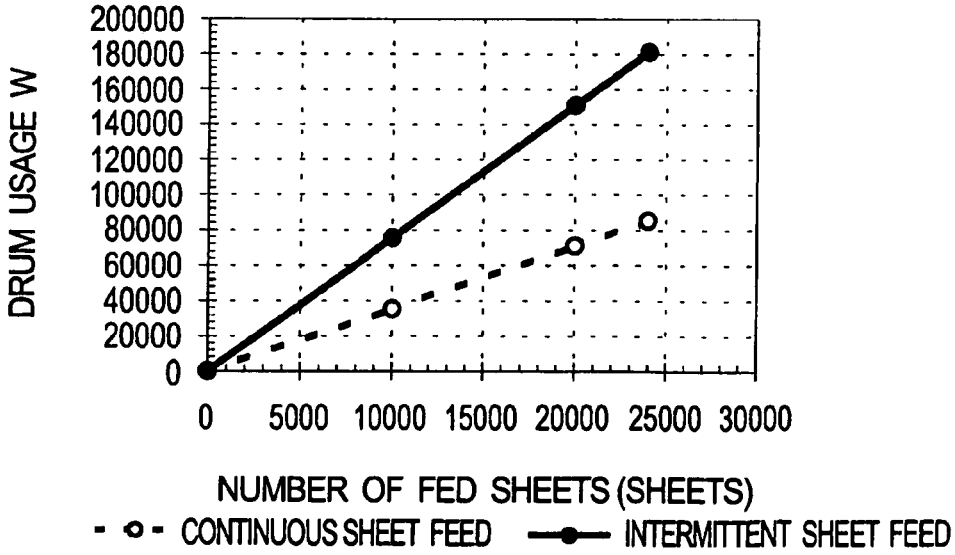
FIG.23

| DRUM USAGE | LASER LIGHT QUALITY |
|---|---|
| 0 | 2.4 mJ/m² |
| 37750 | 2.4 mJ/m² |
| 75500 | 2.6 mJ/m² |
| 113250 | 2.8 mJ/m² |
| 151000 | 3.0 mJ/m² |
| 181200 | 3.2 mJ/m² |

FIG.25

| THRESHOLD | DRUM USAGE | LASER LIGHT QUALITY |
|---|---|---|
| TH1 | 0 | 2.4 mJ/m² |
| TH2 | 37750 | 2.6 mJ/m² |
| TH3 | 75500 | 2.8 mJ/m² |
| TH4 | 113250 | 3.0 mJ/m² |
| TH5 | 151000 | 3.2 mJ/m² |
| TH6 | 181200 | - |

FIG.26

| THRESHOLD | DRUM USAGE | CHARGING BIAS DC COMPONENT | DEVELOPING BIAS DC COMPONENT |
|---|---|---|---|
| TH 1 | 0 | -600V | -450V |
| TH 2 | 37750 | -640V | -490V |
| TH 3 | 75500 | -690V | -530V |
| TH 4 | 113250 | -720V | -570V |
| TH 5 | 151000 | -750V | -600V |
| TH 6 | 181200 | - | - |

(a)

(b)

IMAGE FORMING APPARATUS, CARTRIDGE, AND STORING DEVICE MOUNTED TO THE CARTRIDGE

TECHNICAL FIELD

The present invention relates to an image forming apparatus, particularly an image forming apparatus of electrophotography type, such as a laser beam printer or the like. The present invention also relates to a cartridge therefore and a storing device to be mounted to the cartridge.

BACKGROUND ART

Description will be made with reference to a conventional electrophotographic image forming apparatus such as a laser beam printer.

An ordinary the electrophotographic image forming apparatus forms an electrostatic latent image by irradiating an irradiating an electrophotographic photosensitive member, uniformly charged by a charging means, with light corresponding to image information, and visualize the electrostatic latent image as an image by supplying developer (hereinafter, referred to as "toner") as a recording material by the use of a developing means. Further, the toner image is transferred from the photosensitive member onto a recording paper as a recording medium, and the recording paper P holding the toner is sent to a fixing device so as not to disturb the toner image, which image is then subjected to fixation under heat and pressure by the fixing device to be recorded and outputted as a permanent image on the recording paper. To the developing means, a toner container as a developer containing portion containing the toner is connected. The toner is consumed by forming the image. In many cases, the toner container, the developing means, the photosensitive member, the charging means and so on, are integrally constituted as a process cartridge (hereinafter, referred to as a "cartridge"). When the toner is consumed, a user can form again an image by replacing the cartridge with a new one.

In the cartridge, a predetermined amount of toner determined by a container volume is contained. Accordingly, the number of printable sheets by the user generally correlates with the amount of toner. Users who save the toner by reducing toner consumption to permit a larger number of printable sheets are also increased. In addition, laser beam printers having such an image formation mode, such as a low (toner) consumption mode, capable of automatically decreasing the amount of toner consumption or such a draft mode wherein printing is effected by converting image data to be printed into low resolution image data, image data decreased in the number of gradation levels, or image data decreased in image density are also increased.

As a means for decreasing the toner consumption amount, it is possible to use a means for changing a developing contrast, a means for changing a laser light quantity, etc. By changing the developing contrast or the laser light source, a latent image formed on the photosensitive member is changed. As a result, a toner coverage can be reduced at the time of development.

However, in the case where the amount of toner consumption is decreased only by the developing contrast or the laser light quantity, a thin line image or a character image has a very narrow line width to provide a poor image quality in some cases even under such a condition that a change in image quality is less conspicuous with respect to a solid black image having a large area to some extent.

For this reason, as a means for reducing the toner consumption amount while ensuring the line width, such a control method that an image frame portion constituted by a binary image is printed at an original density but an amount of toner consumption is decreased at an inner portion of the image, is performed to permit a decrease in toner consumption amount while ensuring the line width (e.g., Japanese Laid-Open Patent Application No. Hei 9-085993). More specifically, as shown in FIG. 3, the control method effects such an image processing that an original image (image data) 301 to be printed is changed into a dither image 302 wherein a frame portion, as a concentrated pixel area like a solid black image, is printed at an original density but an inner portion is provided with distributed blank dots which are not printed or a halftone image 303 wherein an amount of emission of laser or a laser on-period is changed on a one dot unit basis.

Herein, such an image formation mode for suppressing a toner coverage by changing an amount of emission or an emission period (or emission time) of a laser on one image dot unit basis is referred to as a "low (toner) consumption mode".

However, the above-described conventional image control means is accompanied with the following problems.

The low toner consumption mode image processing method which has been conventionally used, as described above, a frame portion of a concentrated pixel portion of a resultant image is printed at an original density and the image is converted into a dither image or a halftone image at an inner portion (central portion) to reduce an amount of toner consumption. In this case, the image processing method is uniformly adapted to all the images except for those at the frame portion. A proportion between a pattern of the dither image or a pattern of the halftone image is switched according to the use circumstances, whereby it becomes possible to provide a low consumption mode which maintains image qualities.

However, in the case of effecting a low consumption mode with the dither image, when an amount of toner consumption is intended to be further decreased compared with that in the conventional low consumption mode, there arises such a problem that a blank dot portion is very conspicuous to make an image, to be originally a solid black image, a mesh image.

Further, in the case of effecting a low consumption mode with the halftone image obtained by changing an emission time or an emission light quantity of a scanner laser, there arises such a problem that the low consumption mode is more liable to be affected by a durability change of a photosensitive layer of the photosensitive member. More specifically, with respect to an ordinary laser light in the case where the halftone treatment is not performed, there is substantially no influence by a sensitivity change due to wearing or abrasion of the photosensitive layer caused by long-term use of the photosensitive member. However, with respect to a laser light changed in emission time or emission light quantity, a sensitivity of the photosensitive member becomes lower as the photosensitive layer becomes thinner with a progress of a durability change of the photosensitive layer, i.e., wearing or abrasion of the photosensitive member. As a result, a large density lowering and a deterioration in line width are caused to occur.

Further, it is possible to mount a density sensor for detecting a sensitivity change of the photosensitive member or an surface potential sensor for the photosensitive member to change the emission time or the emission light quantity on the basis of a detection result of the sensor, thus creating the halftone image. However, the mounting of the sensors is accompanied with a problem in terms of cost for incorporating detection circuits for the above-described sensors and a problem regarding ensuring of mounting space for mounting the sensors.

In addition, in the above-described pattern difference in area of image such as the solid black image or line width as in the conventional image control means, an amount of toner consumption required to maintain an image quality is different due to a difference in image area in response cases where the low consumption mode with the dither image is performed, so that it is necessary to sacrifice a decrease degree of the toner consumption amount if the toner consumption amount is uniformly decreased irrespective of image area.

DESCRIPTION OF THE INVENTION

In order to solve the above-described problems, the present invention has been accomplished.

An object of the present invention is to provide an image forming apparatus and a cartridge which are capable of reducing an amount of consumption of developer while retaining stable image qualities irrespective of an amount of usage of an image bearing member.

Another object of the present invention is to provide a storing device to be mounted to a cartridge.

According to the present invention, there is provided an image forming apparatus having a first image formation mode for forming an image on an image bearing member by using developer under a first predetermined image forming condition and a second image formation mode for forming an image on an image bearing member by using developer under a second image forming condition which is different from the first predetermined image forming condition and is set so that an amount of consumption of developer with respect to an identical image in the second image formation mode is smaller than that in the first image formation mode, the apparatus comprising:

storing means for storing information on an amount of usage of the image bearing member, and control means for changing the second image forming condition in the second image formation mode depending on the information stored in the storing means.

According to the present invention, there is also provided an cartridge for being detachably mountable to an image forming apparatus having a first image formation mode for forming an image on an image bearing member by using developer under a first predetermined image forming condition and a second image formation mode for forming an image on an image bearing member by using developer under a second image forming condition which is different from the first predetermined image forming condition and is set so that an amount of consumption of developer with respect to an identical image in the second image formation mode is smaller than that in the first image formation mode, the cartridge comprising:

the image bearing member, and storing means for storing information on the cartridge, the storing means having a first storing area for storing information on an amount of usage of the image bearing member for changing the second image forming condition.

According to the present invention, there is further provided a storing device to be mounted to a cartridge for being detachably mountable to an image forming apparatus including an image bearing member and having a first image formation mode for forming an image on an image bearing member by using developer under a first predetermined image forming condition and a second image formation mode for forming an image on an image bearing member by using developer under a second image forming condition which is different from the first predetermined image forming condition and is set so that an amount of consumption of developer with respect to an identical image in the second image formation mode is smaller than that in the first image formation mode, the storing device having:

a first storing area for storing information on an amount of usage of the image bearing member for changing the second image forming condition.

According to the present invention, there is further provided a storing device to be mounted to a cartridge for being detachably mountable to an image forming apparatus including an image bearing member and having a first image formation mode for forming an image on an image bearing member by using developer under a first predetermined image forming condition and a second image formation mode for forming an image on an image bearing member by using developer under a second image forming condition which is different from the first predetermined image forming condition and are set so that an amount of consumption of developer with respect to an identical image in the second image formation mode is smaller than that in the first image formation mode, the storing device having:

a first storing area for storing information on an amount of usage of the image bearing member for changing the second image forming condition, wherein the information for changing the second image forming condition is information which is used in the second image formation mode but is not used in the first image formation mode.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 13 is a table showing the amount of drum usage and an appropriate reference emission time in Embodiment 1.

FIG. 14 is a table for illustrating switching of reference emission time on the basis of an amount of drum usage in Embodiment 1.

FIG. 17 is a table showing an appropriate laser emission time on the basis of drum usage in order to keep a line width constant in Embodiment 2.

FIG. 18 is a table showing switching of appropriate laser emission times for a line image and a solid black image on the basis of drum usage in Embodiment 2.

FIG. 21 is a graph showing a relationship between the number of fed sheets and an exposure potential on the photosensitive drum in the present invention.

FIG. 22 is a table showing charging bias voltage application times and drum rotation times in the present invention.

FIG. 23 is a graph showing a relationship between the number of fed sheets and a drum usage W in the present invention.

FIG. 25 is a table showing a drum usage and an appropriate laser light quantity in Embodiment 3 of the present invention.

FIG. 26 is a table showing a threshold value and an appropriate laser light quantity in Embodiment 3.

BEST MODE FOR CARRYING OUT THE INVENTION

Embodiment 1

Figure 2:
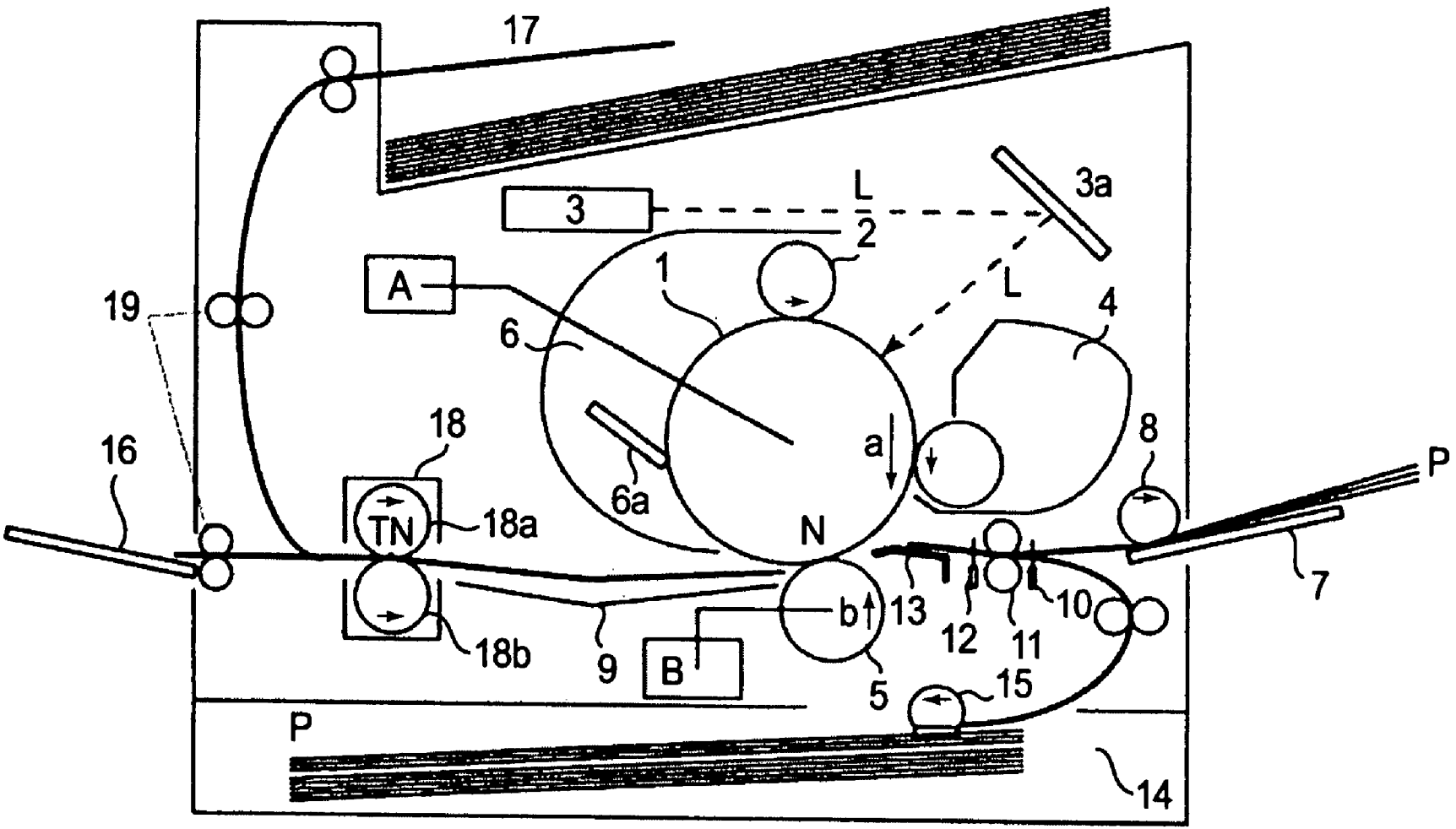
FIG. 2 is a schematic explanatory view for illustrating an image forming apparatus according to the present invention.
Figure 3:
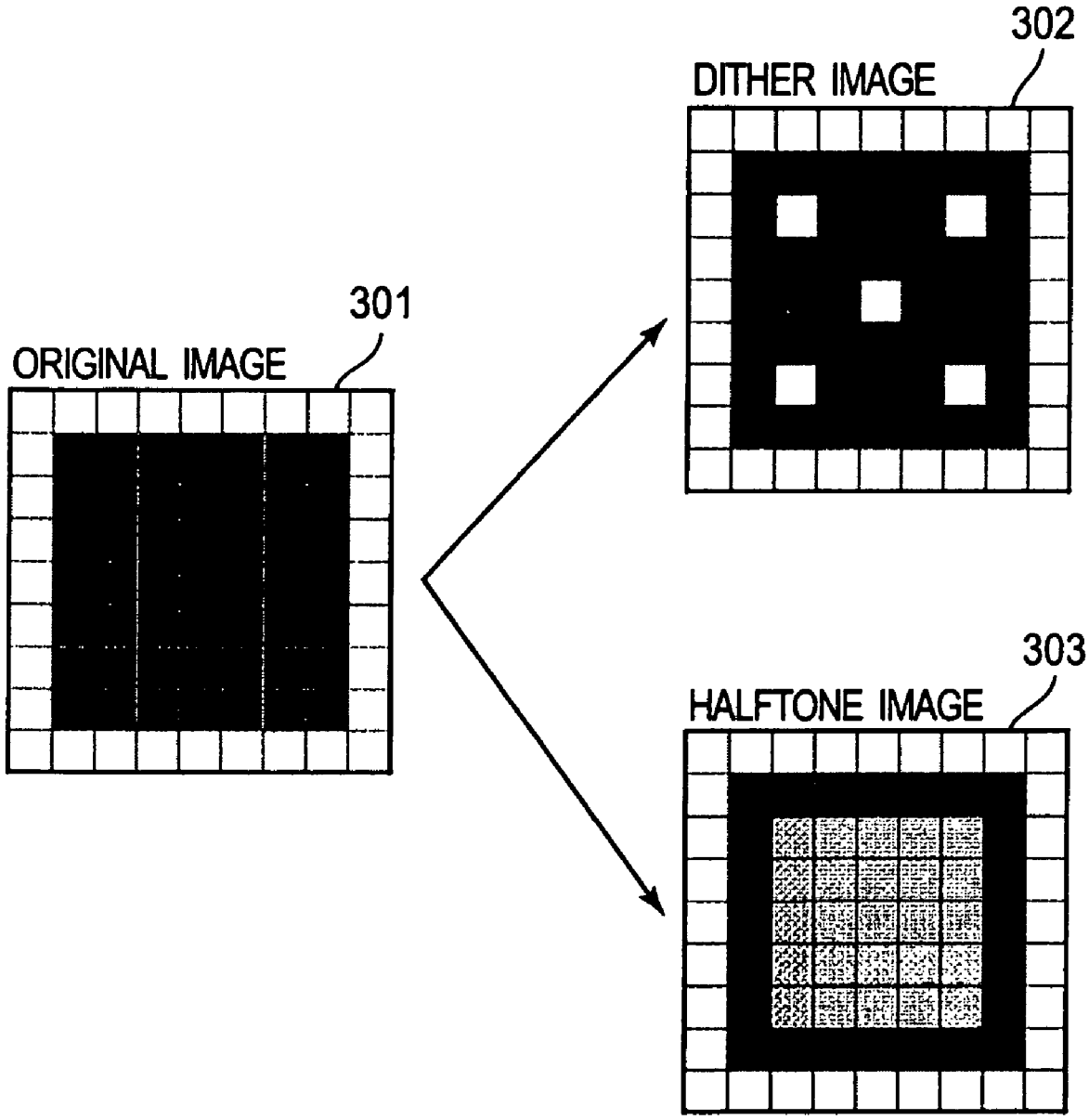
FIG. 3 is a schematic explanatory view for illustrating a conventional image processing.

FIG. 2 is a schematic sectional view showing the image forming apparatus according to threshold information of the present invention.

In FIG. 2, the image forming apparatus includes a photosensitive drum 1, as an image bearing member, which is prepared by forming a photosensitive material such as an OPC or an amorphous Si on a cylindrical substrate of aluminum, nickel, or the like, and is rotationally driven by drive means A, such as a motor, in a clockwise direction of an indicated arrow a at a predetermined peripheral speed.

The image forming apparatus further includes charging means 2 for uniformly charge-treating a peripheral surface of rotating the photosensitive photosensitive drum 1 in a predetermined polarity and a predetermined potential. In this embodiment, a contact charging device using a charge roller is used.

The image forming apparatus further includes image information exposure means 3, and in this embodiment, a laser beam scanner is used as the exposure means.

This scanner 3 includes a semiconductor laser, a polygon mirror, F-θ lens, etc., and scans and exposes the uniformly charged surface of the photosensitive drum by emitting a laser beam L which is ON/OFF controlled depending on image information sent from an unshown host apparatus, thus forming an electrostatic latent image. A developing device 4 constituting a process cartridge develops the electrostatic latent image on the photosensitive drum 1 as a toner image.

As a developing method, a Jumping development, a two component development, or the like is used. In many cases, a combination of image exposure and reversal development is employed.

A transfer roller 5, having an elastic layer, as a rotating member-like contact charging member is caused to contact the photosensitive drum 1 under pressure to form a transfer nip portion N therebetween, and is rotationally driven by drive means B such as a motor, in a counterclockwise direction of an indicated arrow b at a predetermined peripheral speed.

The toner image formed on the photosensitive drum 1 is successively electrostatically transferred onto a recording material P to be recorded (a transfer-receiving material) which is fed from a paper feed portion to the transfer nip portion N.

The recording material P fed from the paper feed portion, such as a manual paper feed portion 7 or a cassette paper feed portion 14 is, after being placed in a standby state by a pre-feed sensor 10, fed to the transfer nip portion N (image forming portion) through registration rollers 11, a registration sensor 12, and a pre-transfer guide 13.

The recording material P is fed to the transfer nip portion N, created between the photosensitive drum 1 and the transfer roller 5, in synchronism with the toner image formed on the photosensitive drum 1 by the registration sensor 12.

Further, in order to solve a double feeding problem that a plurality of recording material sheets are erroneously fed simultaneously at the time of feeding the recording material P at the paper feeding portion, separation rollers (8, 15) or the like are disposed. The recording material P passed through the transfer nip portion N where it receives the toner image, is separated from the surface of the photosensitive drum and fed to a fixing device 18 through a sheet passage 9. The fixing device 18 used in this embodiment is a film heating type fixing device consisting of a pair of pressing rollers including a heating film unit 18*a* and a pressure roller 18*b*. The recording material P holding the toner image is sandwiched and fed in a fixing nip portion TN which is a pressure-contact portion between the heating film unit 18*a* and the pressure roller 18*b*, and subjected to heat and pressure application, whereby the toner image is fixed on the recording material to become a permanent image.

The recording material P on which the toner image is fixed is guided by discharge rollers 19 to be discharged in a face-up discharge port (tray) 16 or a face-down discharge port (tray) 17.

On the other hand, the surface of the photosensitive drum after being subjected to transfer of the toner image onto the recording material P is cleaned by removing a transfer residual toner by a cleaning device 6 of the process cartridge, thus being repetitively subjected to image formation. In this embodiment, the cleaning device 6 a blade cleaning device having a cleaning blade 6*a*.

Then, a controller and the process cartridge of the image forming apparatus according to the present invention will be described in detail with reference to FIG. 1.

An electrophotographic image forming apparatus (hereinafter, simply referred to as "(apparatus) main assembly") used in this embodiment is a laser beam printer which receives image signals from a host computer and outputs the signals as a visualized image. The apparatus is of the type wherein consumable members, such as the electrophotographic photosensitive member, the developing means, and the developer (toner), are integrally supported as a process cartridge which is detachably mountable to the apparatus main assembly.

Figure 1:
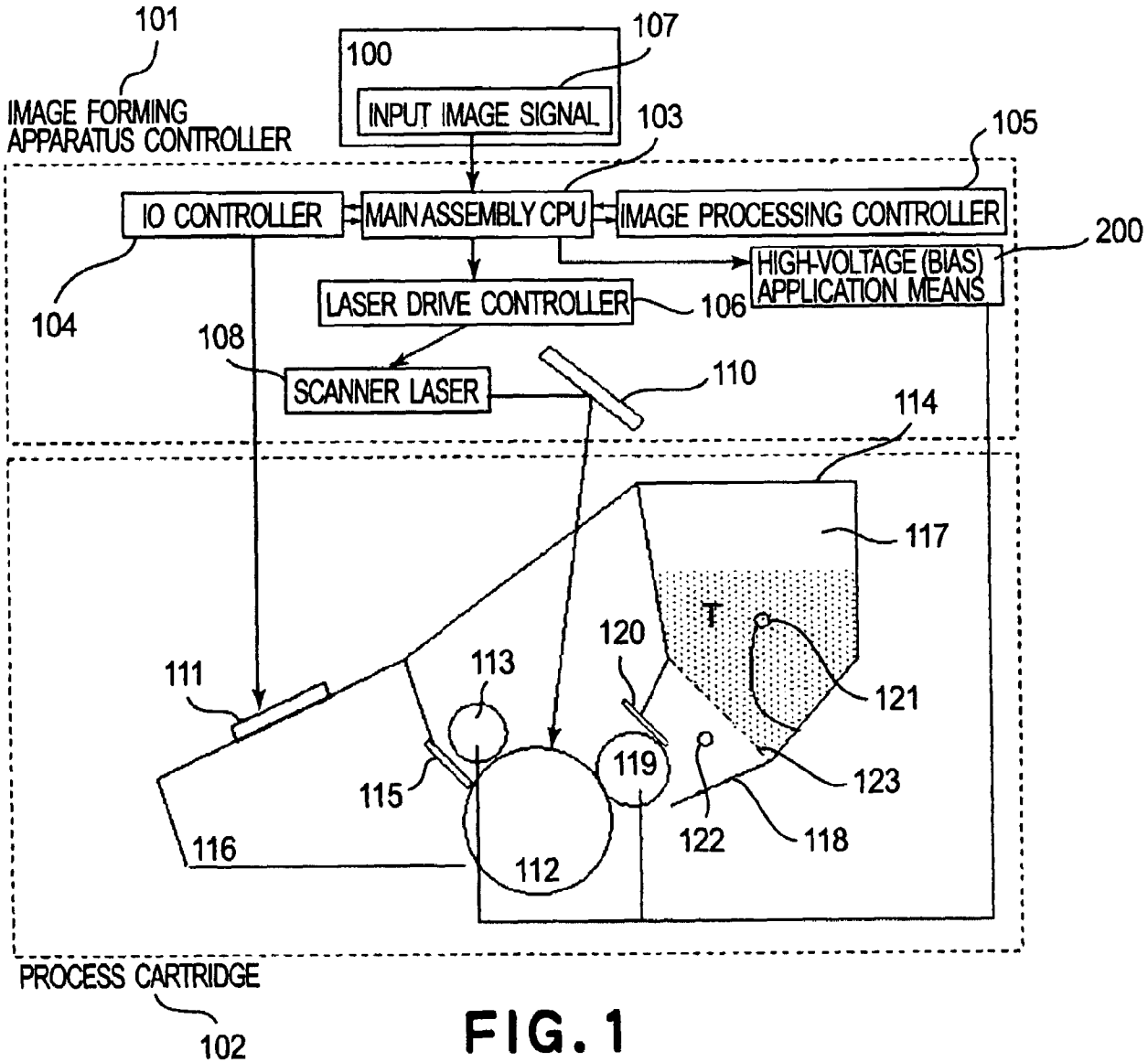
FIG. 1 is a schematic explanatory view for illustrating image formation according to the present invention.

As shown in FIG. 1, an image forming apparatus controller 101 includes a (main assembly) CPU 103 as a central processing computing unit for performing image forming operation of the main assembly, an IO controller 104 for effecting communication with a storing device mounted to the cartridge, an image processing controller 105 for effecting image processing of a resultant image signal, and a laser drive controller 106 for performing emission control of a scanner laser depending on an output image signal.

In the case where a process cartridge 102 is inserted into the apparatus main assembly and then a power to the main assembly is turned on, the IO controller 104 communicates with a storing device 111 mounted to the cartridge 102 to obtain various storage values, such as the process condition and an operating history. The resultant storage values obtained by the IO controller 104 are sent to the main assembly CPU 103, and treated with those stored in the storing device 124, and treated as data at the time of effecting image formation.

The image signal 107 sent from a computer or an image reading scanner as an image signal input unit 100 connected to the image forming apparatus is subjected to image processing, such as an edge treatment or a density adjustment, thus being treated as an image signal capable of effecting an optimum image formation.

The main assembly CPU 103 computes an optimum process condition value from the storage value obtained from the storing device 111 of the cartridge and the image signal to which image processing is completed, and forms an image at the optimum process condition value.

Further, the process cartridge 102 is prepared by integrally supporting the photosensitive drum 112 as an electrophotographic photosensitive member, a charge roller 113 as a charging means for uniformly charging the photosensitive drum 112, a developing device 114, a cleaning blade 115 as a cleaning means for cleaning the surface of the photosensitive drum 112, and a waste toner container 116 for containing a residual toner removed from the photosensitive drum 112 by the cleaning blade 115, and is detachably mounted to the apparatus main assembly.

The developing device 114 includes a toner container 117 as a developer containing portion for containing toner T as developer, a developer container 118 connected with the toner container 117, a developing roller 119 as a developing means disposed opposite to the photosensitive drum 112, a developing blade 120 as a developer regulation member for regulating a toner layer thickness, a toner container inner stirring member 121 for stirring the toner T in the toner container 117 to feed the toner T into the developer container 118, and a stirring member 122 for feeding the toner T fed from the toner container 117 to the developing roller 119.

Further, before the cartridge is used, a toner sealing member 123 is adhered between the toner container 117 and the developer container 118.

The toner sealing member 123 is disposed so as to prevent the toner from leaking even in the case where a strong impact is caused to occur, e.g., during transport of the cartridge, and is removed by a user immediately before the mounting of the cartridge to the main assembly.

Incidentally, in this embodiment, insulating magnetic one component toner is used as the developer.

In the storing device 111 used in this embodiment, image forming process set values, such as charging and developing bias voltage set values required for image formation and a light quantity set value of the laser as the exposure means, and amounts of usages, such as an amount of usage of the photosensitive drum and an amount of residual toner, are stored. Further, in the case where the bias voltage set value or the like is switched depending on a sheet feeding history, in the storing device 111, e.g., threshold information or a set value which is switched based on the threshold information is stored.

By using the above described structure, the photosensitive drum is uniformly charged with the charge roller by applying a bias voltage from a high-voltage application unit 200 to the charge roller in accordance with an instruction from the CPU 103, and the surface thereat is subjected to scanning exposure with laser light 109, reflected by a mirror 110 and guided to the photosensitive member, varying depending on an image signal emitted from a laser scanner 108 as an exposure means, whereby an electrostatic latent image providing an objective image information is formed. The electrostatic latent image is visualized as a toner image by attaching the toner thereto by applying a bias voltage from the high-voltage application unit 200 to the developing roller, in accordance with an instruction from the CPU 103, to carry the toner to the photosensitive member through the developing roller.

Figure 4:
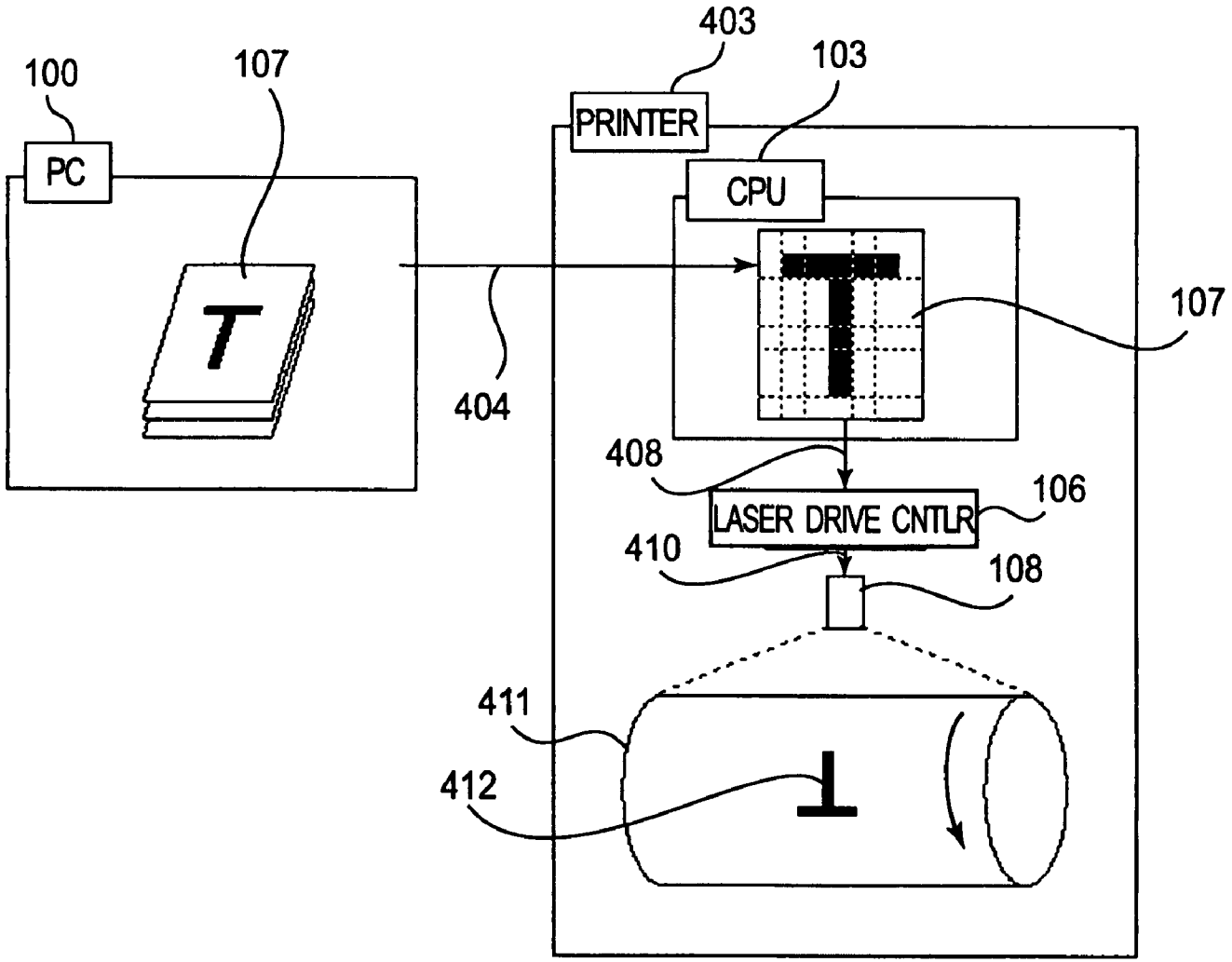
FIG. 4 is a schematic explanatory view for illustrating image formation of the present invention.

FIG. 4 is a view showing the flow of image processing and outline of the image processing will be described with reference to FIG. 4.

Identical reference numeral (signs) are indicated for members (means) identical to those shown in FIG. 1.

Referring to FIG. 4, to a main assembly of a printer, a computer equipment 100 such as a personal computer or a host computer which transmits image information 107 such as a character (text) or graphics, is connected. The computer equipment sends the image information 107 to the printer main assembly through a signal line 404, and the sent image information 107 is sent to a main assembly CPU 103 in the printer main assembly 403 or a volatile storing device (not shown), provided in the CPU 103, for temporarily storing image data up to a period wherein an image is outputted.

When it is confirmed that all the image information 107 to be printed on one recording sheet are obtained, the printer main assembly starts a printing operation. After the start of the printing operation, the image information 107 is sent to a laser drive controller 106 through a signal line 408. On the basis of the image information 107, the laser drive controller 108 transmits a signal for controlling emission/non-emission of laser light of a laser scanner 108 through a signal line 410, thus forming an electrostatic latent image 412 on a photosensitive member 411.

Into the image data sent from the computer equipment, an emission control code for the laser scanner is inputted every one dot which is a minimum resolution of the printer main assembly. For example, a binary data as to whether the dot is printed or not printed is stored, or a multi-level data including halftone data for gray is stored. The minimum resolution unit, i.e., one dot is referred to as one pixel.

Based on the binary or multi-level data every one pixel, an emission time or light quantity of the laser scanner 108 is controlled, whereby a potential difference of the electrostatic latent image is provided on the photosensitive member to control a toner coverage and adjust a density, thus providing a good gradation characteristic.

In an ordinary image formation mode, based on the data for each one pixel corresponding to an image signal, an amount of emission (emission time or emission light quantity) of the laser scanner 108 is controlled by the CPU 103, whereby laser emission is caused to occur, thus forming an image on the photosensitive member through formation of a latent image.

On the other hand, there is a mode for forming an image under an image forming condition different from that in the ordinary image formation mode, i.e., a low toner consumption mode for effecting printing by further reducing an amount of toner consumption than the ordinary image formation mode to save the toner. The low toner consumption mode in this embodiment will be described with reference to FIG. 5. The image processing method in this embodiment is effected on the basis of a degree of concentration of pixels in order to reduce an ununiform amount of toner consumption.

With respect to selection of the ordinary image formation mode and the low toner consumption mode, it is possible to select the modes by a switch of an operation panel (not shown) provided to the image forming apparatus or command input from an external computer (e.g., 100 of FIG. 1).

Figure 5:
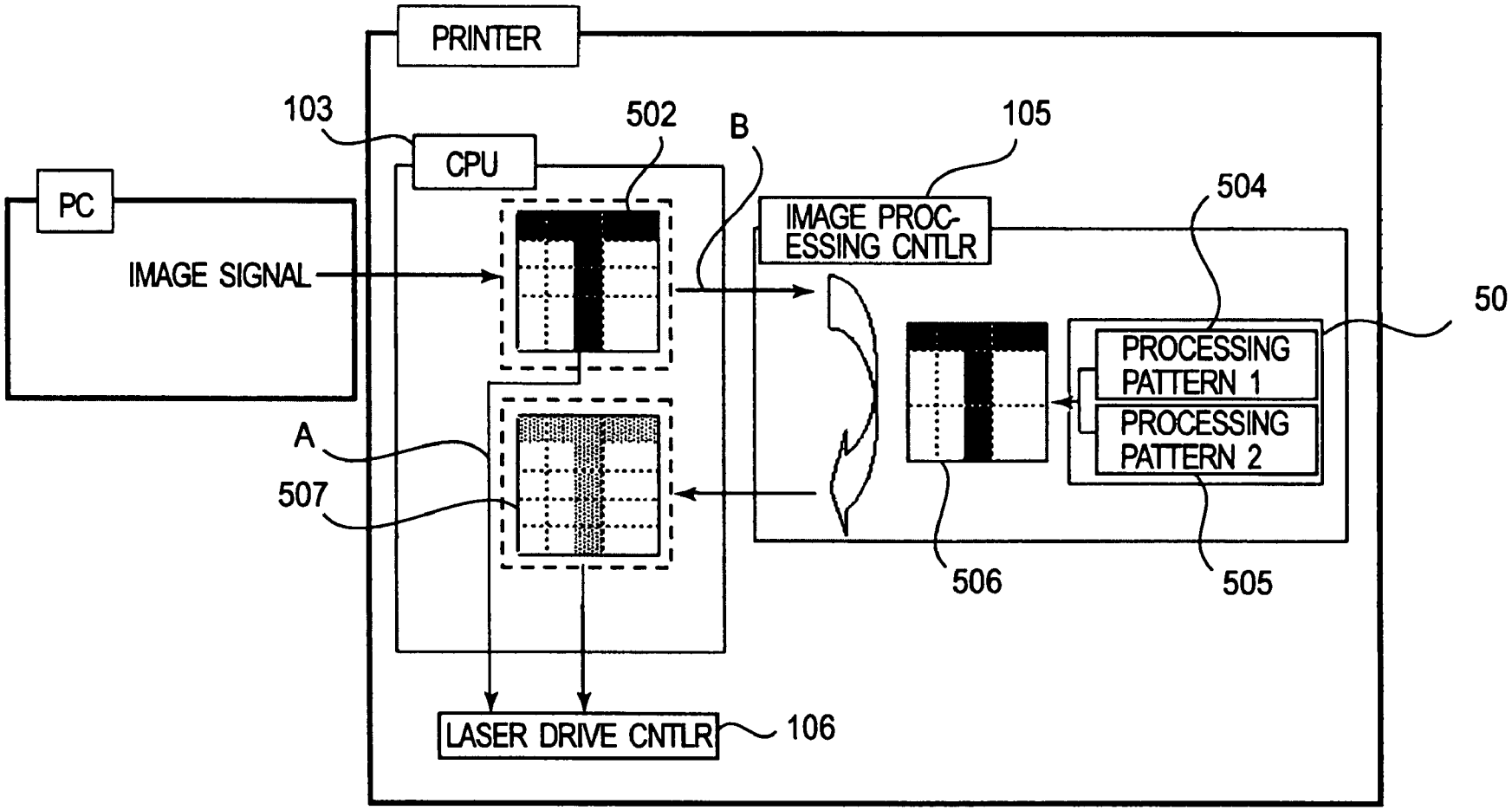
FIG. 5 is a schematic explanatory view for illustrating image processing according to the present invention.

FIG. 5 is a diagram showing a flow of image forming processing. Identical members (means) are indicated for members (means) identical to those shown in FIG. 1.

Referring to FIG. 5, image information sent from a external computer 100 to a laser (beam) printer is received by a CPU 103 of the laser printer and is stored in the CPU 103 or a storing device (not shown).

The CPU 103 makes a judgment whether printing is performed in the ordinary image formation mode or the low toner consumption mode in accordance with an instruction signal from an unshown operation panel or a command from an external computer. In the case where the printing mode is determined as the ordinary image formation mode, a image information (original image) 502 is sent to a laser drive controller 106 as shown by an arrow A. On the other hand, in the case where the printing mode is determined as the low toner consumption mode, the image information (original image) 502 is sent to an image processing controller 105 for effecting image processing. In the image processing controller 105, the original image is analyzed pixel by pixel, so that a pixel area is classified into the case of a concentrated pixel area having a small size and the case of a concentrated pixel area having a large size. In the case of the small size-concentrated pixel area, image processing is performed in a processing pattern 504 and in the case of the large size-concentrated pixel area, image processing is performed in a processing pattern 505. After the image processing to image information 506 sent to the image processing controller 105 is completed, the resultant image information is again sent to the CPU 103 of the apparatus main assembly and is sent to the laser drive controller 106 as a processed image 507 after the image processing, thus being used for emission control.

Figure 6:
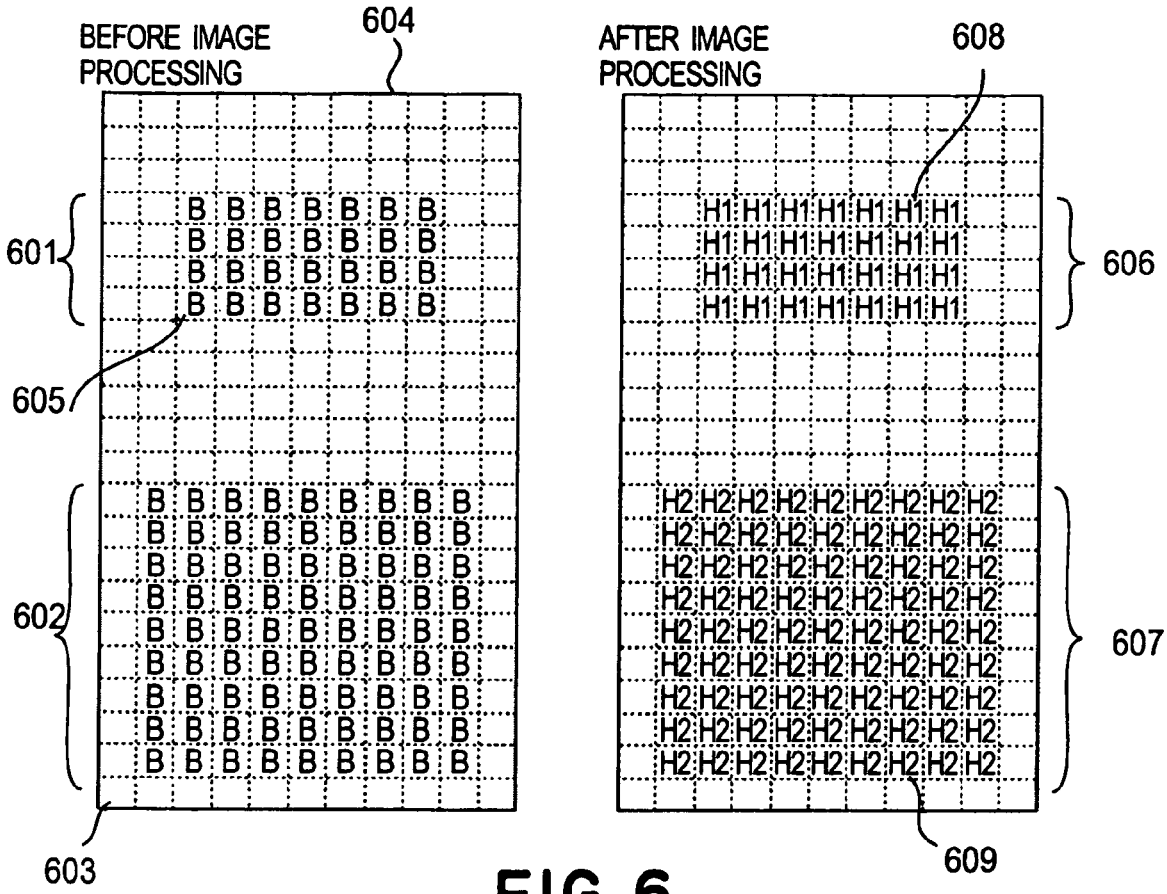
FIG. 6 is a schematic explanatory view regarding image information in the present invention.

FIGS. 6(*a*) and 6(*b*) are views for illustrating an effect of image processing in the case of reducing an amount of toner consumption.

In FIG. 6(*a*), there are a small area image 601 having a relatively small pixel area for development and a large area pixel 602 having a relatively large pixel area for development. These small and large area images 601 and 602 are indicated in image information 604 as a part thereof.

Referring to FIG. 6(*a*), a cell 603 shows one pixel and corresponds to 1/600 inch in the case of a resolution of 600 dpi. A pixel 605 indicated by "B" is a pixel to which a dot is printed by development, and a blank pixel (which is not indicated by "B") is a pixel to which a dot is not printed.

With respect to the concentrated pixel area 601 which is determined as the small area image in the image processing CPU 103, image processing is performed according to the image processing pattern (504 of FIG. 5) for the small area image. Further, with respect to the concentrated image area 602 which is determined as the large area image, image processing is performed according to the image processing pattern (505 of FIG. 5) for the large area image.

In this embodiment, the large area-concentrated pixel area is, e.g., a concentrated pixel area having not less than 8 dots in a main-scanning direction and not less than 8 dots in a sub-scanning direction. The small area-concentrated pixel area is, e.g., a concentrated pixel area having not more than 7 dots in the main-scanning direction and not more than 7 dots in the sub-scanning direction. The determination as to the large/small area-concentrated pixel areas is not limited to the above manner but can be appropriately modified.

In image information after the image processing shown in FIG. 6-*b*, the pixels processed as the small area image 606 are processed as a halftone gradation data (halftone) H1 (608) which does not largely lower a density. Further, the pixels processed as the large area image 607 are processed as a halftone gradation data (halftone) H2 (609) which reduces the toner consumption amount as low as possible while retaining the density. The image processing condition of the halftone H2 for processing the large area image is set so that a degree of lowering in density by the image processing condition is larger than that by the image processing condition of the halftone H1.

Figure 7:
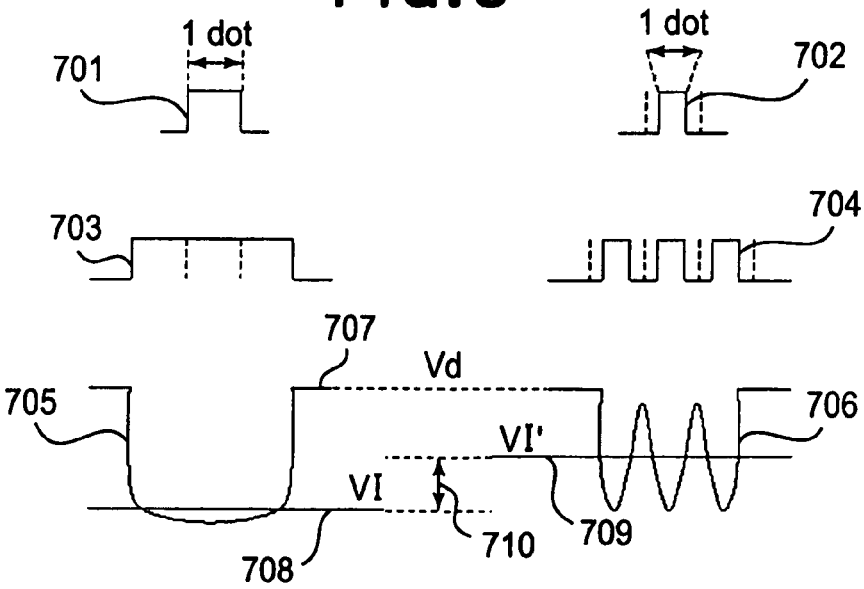
FIG. 7 is a schematic explanatory view regarding an electric potential on a photosensitive member used in the present invention.

With reference to FIG. 7, description will be made on laser emission control which is effected on the basis of formation of halftone image by analysis of binary data used in this embodiment.

In this embodiment, a laser emission time is controlled to generate a potential difference at an exposure portion on the photosensitive member on the basis of the emission time.

In FIG. 7, a laser emission time 701 necessary to form one dot depending on the resolution of printer is shown. A solid black image is formed by causing emission 703 in succession of one dot-forming period. At this time, a potential 705 on the photosensitive member becomes an exposed light-part potential Vl 708 relative to a dark-part potential Vd 707 of the photosensitive member.

A laser emission time per one pixel which is basis necessary to form one pixel is referred to as "reference emission time" 701.

In the case where a laser emission time is controlled to be 50% of the reference emission time 701, a resultant laser emission time 702 for creating one dot is as shown in an upper-light portion of FIG. 7. A solid black image to which such a control that the laser emission time is controlled to be 50% of the reference emission time, is formed by continuous emission 704 at the laser emission time 702. As a result, a potential 706 on the photosensitive member has a light-part potential Vl' 709 at an exposed portion relative to the surface potential Vd 707 of the photosensitive member. Accordingly, a latent image potential on the photosensitive member is changed to provide a difference 710 between the exposure potentials Vl and Vl', thus changing an amount of toner consumption. A difference between the exposure potential Vl and a DC component of a developing bias voltage is referred to as a developing contrast. Further, a difference between the dark-part potential Vd and the DC component of a developing bias voltage is referred to as a back contrast.

Figure 8:
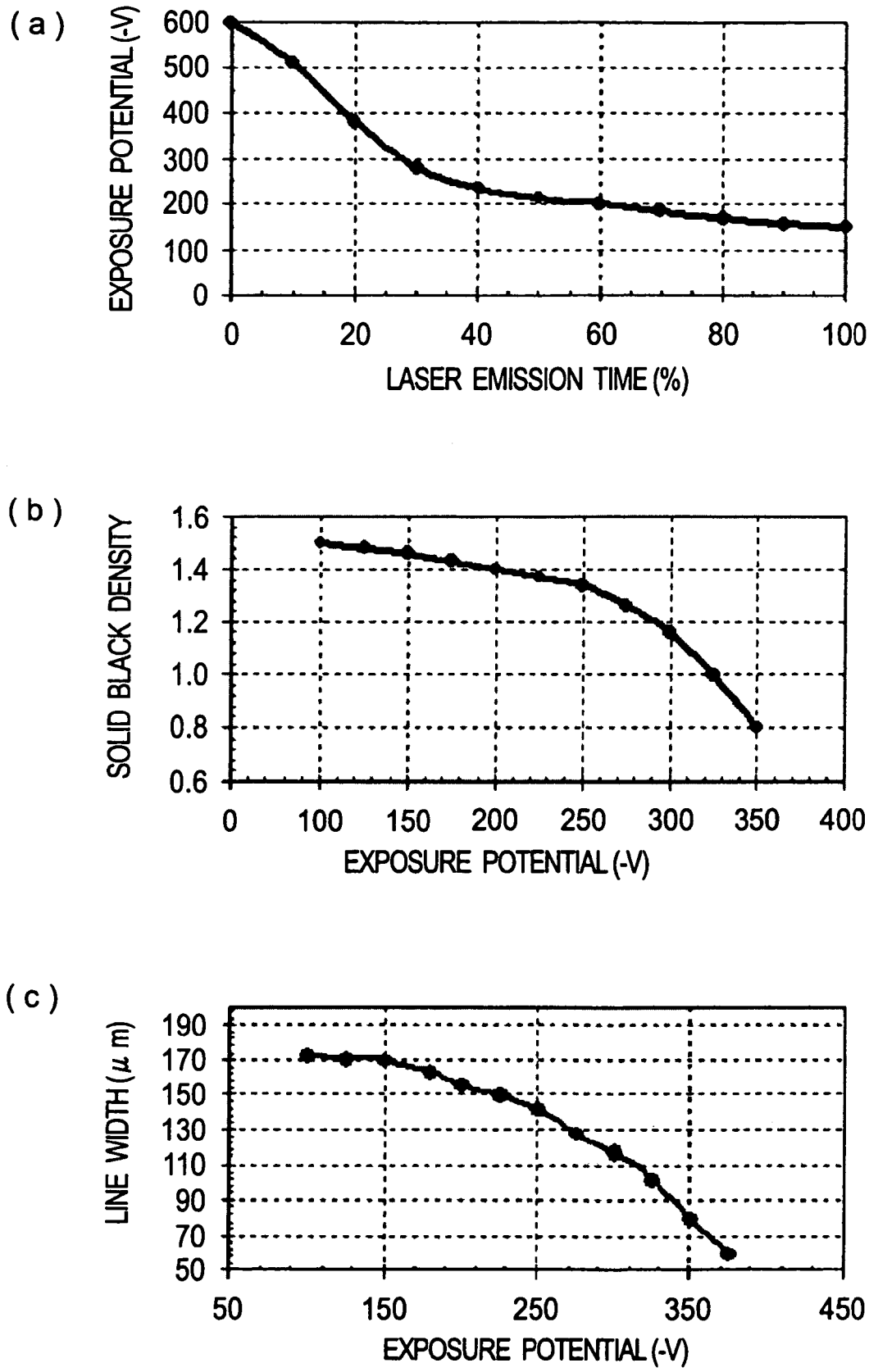
FIGS. 8(*a*), 8(*b*) and 8(*c*) are graphs showing relationships between a laser emission time and an exposure potential on a photosensitive member, between the exposure potential and a solid black density, and between the exposure potential and a line width, respectively, in the present invention.

FIG. 8(*a*) shows a relationship between the laser emission time and the exposure potential (light-part potential) Vl on the photosensitive drum (photosensitive member). The abscissa represents a degree (proportion) (%) of the laser emission time per the reference emission time. As shown in FIG. 8(*a*), when the laser emission time is 100% to 60% per the reference emission period, a change in the exposure potential Vl on the photosensitive drum is small. Further, also in the case of not more than 60% per the reference emission period, the change is small but is gradually increased with a decrease of the laser emission time.

FIG. 8(*b*) shows a relationship between the exposure potential Vl on the photosensitive drum and a solid black (image) density. As shown in FIG. 8(*b*), the solid black density is changed non-linearly with respect to the exposure potential. Particularly, as the exposure potential Vl becomes small (large in terms of an absolute value), the solid black density is abruptly decreased. Further, a satisfactory value of the solid black density is generally not less than 1.4, so that a necessary exposure potential on the photosensitive drum at this time is found to be not less than −200 V. Accordingly, the laser emission time can be reduced to about 60% per the reference emission time as understood from FIG. 8(*a*).

FIG. 8(*c*) shows a relationship between the exposure potential Vl on the photosensitive drum and a line (image) width. The line width in this case is determined by measuring a drawn line having a 4 dot-width (about 170 μm) at a resolution of 600 dpi with a microscope. As shown in FIG. 8(*c*), it is found that the line width is moderately changed relative to the exposure potential, i.e., gradually decreased with the decrease in exposure potential Vl similarly as in the case of the solid black density. Further, with respect to the 4 dot-line width (170 μm), a necessary line width for providing a satisfactory image quality is about 165 μm. For this reason, in order to obtain a line width of not less than 165 μm, it is found that the exposure potential on the photosensitive drum is required to be not less than −180 V. Accordingly, as understood from FIG. 8(*a*), the laser emission time can be reduced to about 80% per the reference emission time.

As shown in the graphs (FIGS. 8(*a*) to 8(*c*)), the solid black density and the line width affect the exposure potential on the photosensitive drum. Particularly, the exposure potential is changed largely with respect to the solid black image. Further, it is formed that the exposure potentials for the respective images (solid black image and line image) for maintaining satisfactory image qualities are different from each other.

Figure 9:
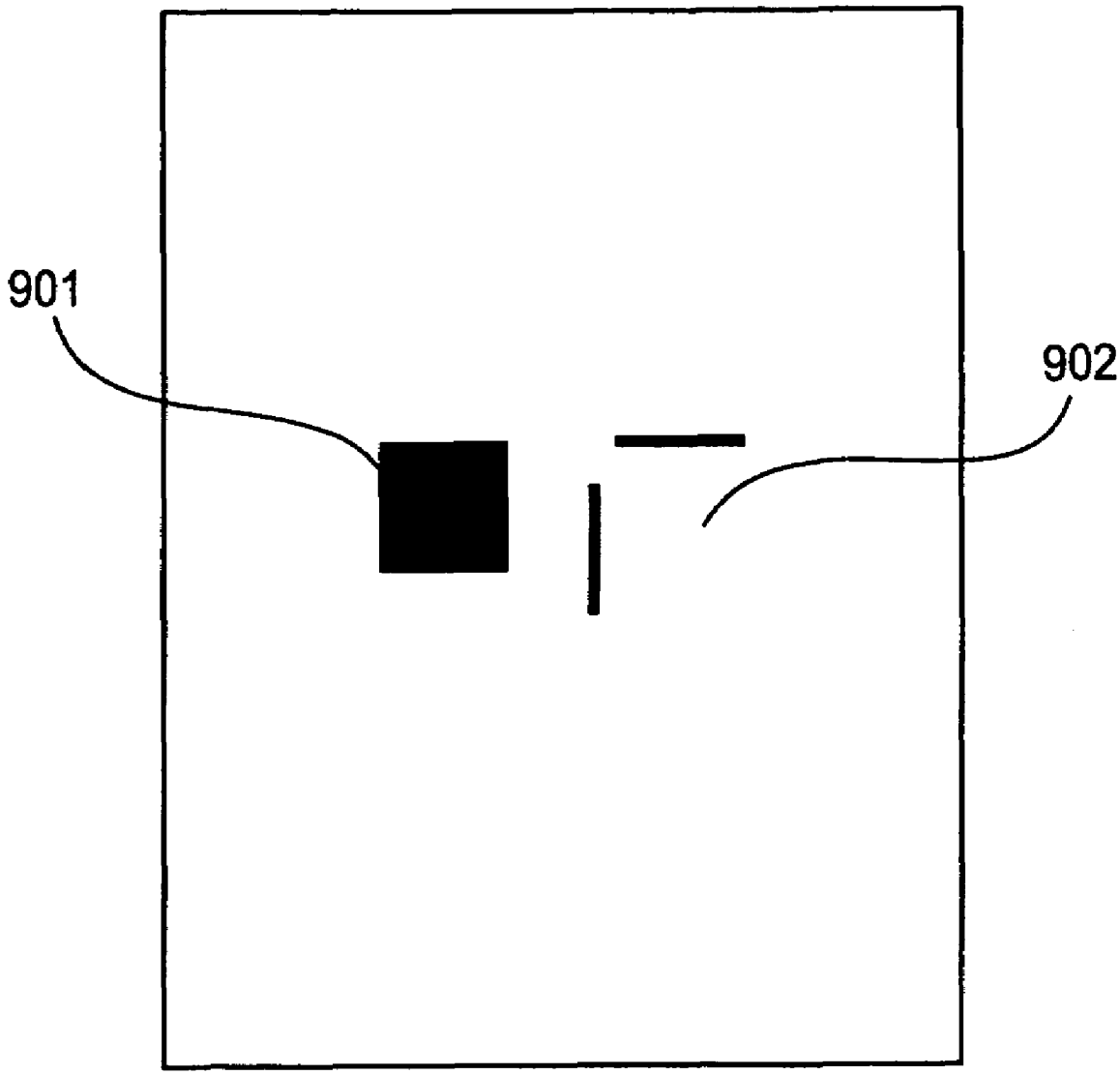
FIG. 9 is a schematic explanatory view for illustrating a measurement sample for measuring the solid black density and a line width in the present invention.

FIG. 9 shows image data subjected to confirmation of the progression of the solid black density and the line width. As shown in FIG. 9, the image data include, at a central portion on, e.g., a A4-size recording sheet, a 5 cm-square solid black image 901 for measuring the solid black density and adjacent vertical and horizontal lines 802, each having a length of 5 cm (1180 dots) and a 4 dot-width, for measuring the line width. The solid black (image) density is measured by using a reflection density measuring apparatus ("RD 918", mfd. by Macbeth Corp.) with respect to the square solid black image. Further, the line width is determined by measuring respective line widths of the vertical and horizontal lines through a microscope and obtaining an average of these widths.

In this embodiment, an experiment is made on changes in solid black density and line width depending on the number of fed sheets under conditions such that the laser emission time for the large area image such as the solid black image 901 is set to 60% and that for the small area image such as the line image 901 is set to 80%, on the basis of the predetermined laser emission time for one dot (the reference emission time).

In this experiment, a process speed is set to 200 mm/sec and an image forming apparatus wherein 30 recording sheets (A4-size) can be continuously fed in its longitudinal direction, is used.

The toner cartridge contains 1000 g of toner and permits the number of sheet feeding of 16000 (sheets) at an amount of toner consumption of 60 mg per one sheet. A resolution of the image forming apparatus is 600 dpi and a laser emission time for one dot as a basis for creating one dot is 63 nsec in this case. The A4-size recording sheets are fed in an intermittent sheet feeding mode in which the drive of the image forming apparatus is stopped every one sheet printing. Further, in this embodiment, image formation is performed in such a low toner consumption mode, through control of laser emission time, concentrated pixel areas are discriminated such that an area having a size of not more than 10 dots×10 dots is determined as a small area and an area having a size of hot less than 11 dots×11 dots is determined as a large area.

The measurements of the solid black density and the line width are performed by using the image sample shown in FIG. 9, and the sampling is effected every 2000 sheets. Further, in this experiment, measurement of the solid black density and the line width is performed through printing effected so as to provide the number of fed sheets (as integrated value) 1.5 times that in the case of ordinary use (with no particular decrease in amount of toner consumption) since the laser emission time per the reference emission time is set to 60% for the large are 80% for the small area for the purpose of examining the progression of the solid lack density and the line image in the case of employing the low consumption mode.

Figure 10:
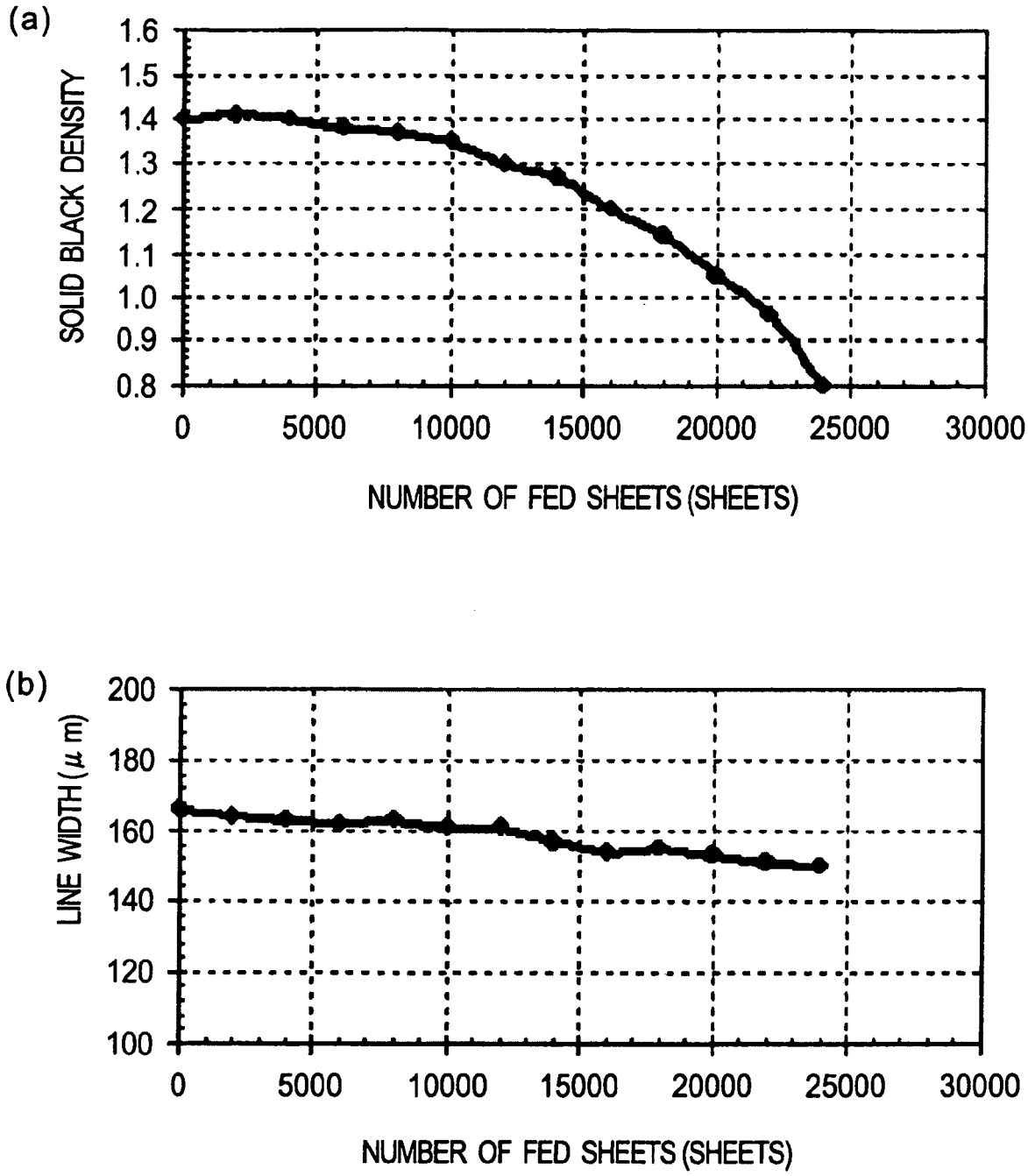
FIGS. 10(*a*) and 10(*b*) are graphs showing relationships between the number of fed sheets and the solid black image, and between the number of fed sheets and the line width, respectively, in the present invention.
Figure 11:
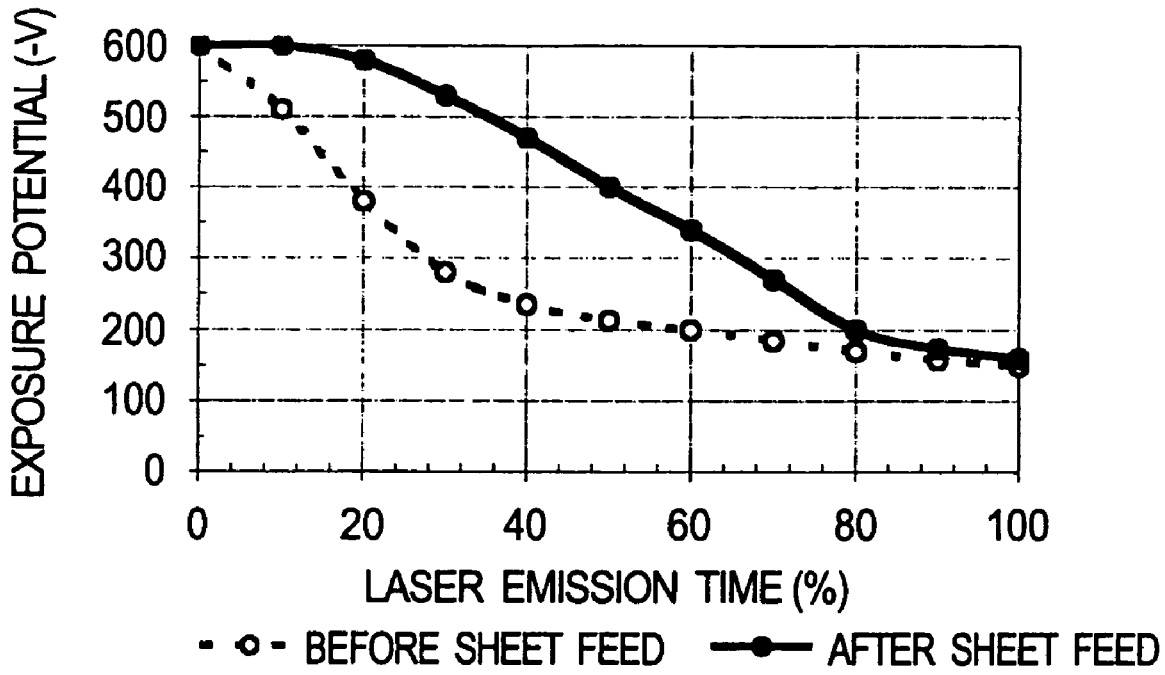
FIG. 11 is a graph showing a relationship between the laser emission time and the exposure potential on the photosensitive member before and after sheet feeding in the present invention.

As a result, as shown in FIG. 10(*a*) for the progression of solid black density and FIG. 10(*b*) for the progression of line width, both of the solid lack density and the line width are found to be decreased with an increasing number of fed sheets. Accordingly, by using the toner cartridge after completion of the continuous printing, the laser emission time and the exposure potential on the photosensitive drum are measured. As a result, as shown in FIG. 11, compared with the progression at an initial stage of sheet feeding indicated by a dotted line, the progression after completion of sheet feeding indicated by a solid line shows that the exposure potential on the photosensitive drum is increased after completion of sheet feeding. Further, it is found that the exposure potential is not substantially changed before and after the sheet feeding in the case where the laser emission time is 100% but is largely changed at the laser emission time in the vicinity of 60%.

Figure 12:
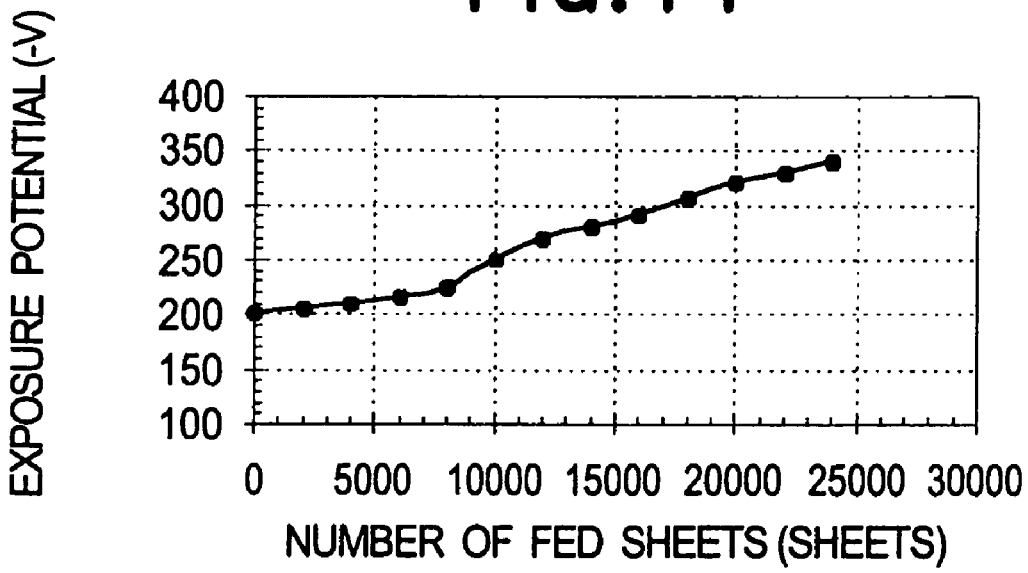
FIG. 12 is a graph showing a relationship between the number of fed sheets and the exposure potential on the photosensitive member in the present invention.

Further, when the progression of the number of fed sheets and the exposure potential on the photosensitive drum is examined with respect to the solid black image considerably deteriorated in particularly image quality, as shown in FIG. 12, the exposure potential is found to be substantially linearly changed with the number of fed sheets. In other words, it shows that an exposure characteristic of the photosensitive drum for the toner cartridge is changed by the sheet feeding test.

This change in exposure characteristic of the photosensitive drum is considered to be attributable to a change in thickness of the photosensitive layer. Further, since the thickness change of the photosensitive layer is changed depending on the number of fed sheets, the exposure potential on the photosensitive drum is also found to be changed depending on the number of fed sheets. In addition, the progression of the solid black density at the laser emission time, which is considerably deteriorated as shown in FIG. 8(*a*), of 60% per the reference emission time is largely changed as the exposure potential on the photosensitive drum is decreased. Accordingly, the above described changes are problems peculiar to the case of employing the low consumption mode using the image processing method wherein the toner consumption amount is changed by decreasing the laser emission time other than the low consumption mode, the change in exposure potential on the image bearing member, i.e., the density change of the solid black image or the change in line width are at a level of substantially no problem.

The thickness change of the photosensitive layer is changed depending on the number of fed sheets as described above. However, the relationship between the number of fed sheets and the thickness change of the photosensitive layer is changed depending on a sheet feeding condition, such as intermittent sheet feeding or a continuous sheet feeding. This is because the change in photosensitive layer thickness is caused by wearing or abrasion of the drum surface layer and is depending on the number of rotation of the photosensitive drum and the application time of the charging bias voltage. For this reason, in this experiment, sheet feeding is performed in the intermittent mode wherein the sheet feeding is stopped every one sheet. In this intermittent mode, the charging bias voltage is applied and the number of rotation of the photosensitive member is increased not only in a period of sheet feeding but also during pre-rotation treatment and post-rotation treatment, thus most quickly wearing the photosensitive layer in the sheet feeding test. For example, as shown in FIG. 21, when the exposure potentials on the photosensitive member in the case of the intermittent sheet feeding having a higher wearing speed of the photosensitive member and the case of the continuous sheet feeding having a lower wearing speed are compared, it is found that the change in exposure potential with the number of fed sheets in the continuous sheet feeding is more moderate them the case of the intermittent sheet feeding.

Accordingly, with respect to the photosensitive layer thickness change of the photosensitive member, compared with the change with the number of fed sheets, it is appropriate that an amount of usage of the photosensitive member (drum usage) which is the sum of the charging bias voltage application time multiplicated by a wearing contribution ratio of the photosensitive layer and the drum rotation time multiplied by a wearing contribution ratio of the photosensitive layer, is used. In this embodiment, the amount of usage of the photosensitive drum correlated with the photosensitive layer thickness of the photosensitive member is employed.

The drum usage usage is calculated according to the following equation:

$$W=a\times Pt+b\times Dt,$$

where W represents an drum usage, Pt represents a charging bias voltage application time (period), Dt represents a rotation time (period) of the photosensitive drum, and a and b represent a contribution ratio with respect to a thickness change of the photosensitive layer.

In this embodiment, a=1 and b=0.5. Further, Pt and Dt are shown in FIG. 22. Referring to FIG. 22, in the case of the intermittent sheet feeding, the application time (or the rotation time) is the sum of those at the time of pre-rotation, sheet feeding, and post-rotation. On the other hand, in the case of continuous sheet feeding, the application (rotation) time is the sum of those at the time of sheet feeding and sheet feeding interval since the pre-rotation and the post-rotation are not performed.

FIG. 23 shows a correlation between the number of fed sheets and drum usage (W) in the cases of the intermittent sheet feeding (higher wearing speed) and the continuous sheet feeding (lower wearing speed).

In this embodiment, the intermittent sheet feeding mode is employed as the sheet feeding mode.

In this embodiment, depending on the drum usage of the toner cartridge, a predetermined reference emission time (laser emission time) per one dot of a concentrated pixel is changed to effect such a control wherein the exposure potential on the photosensitive drum is kept constant irrespective of the number of fed sheets (drum usage).

In this embodiment, each of a charge ratio of a laser emission time to a reference emission time per one dot for a large area concentrated pixel area such as a solid black image and a change ratio of a laser emission time to a reference emission time per one dot for a small area concentrated pixel area such as a line image are set to a constant value irrespective of the number of fed sheets (drum usage). More specifically, the change ratio for the large area concentrated pixel area is 60% and the change ratio for the small and a concentrated pixel area is 80%.

Accordingly, in this embodiment, a modulation degree of laser (a charge ratio of laser emission time) is, e.g., fixed to 60% or 80% to change the laser emission time per one dot as a reference value, thus providing the exposure potential on the photosensitive drum with a desired value.

In this embodiment, the experimental equipments (the image forming apparatus and the cartridge) used in the above described experiment are used.

Further, the change in solid black image density depending on the number of fed sheets (drum usage) is particularly large, so that attention is directed toward the solid black image in this embodiment to make a study.

First, the laser emission time per the referential one dot (reference emission time) necessary to provide an exposure potential of −200 V on the photosensitive drum at which a solid black image has a density of not less than 1.4 at respective number of fed sheets is examined.

Measurement is made very 5000 sheets in this embodiment. As a result, the laser emission time per the referential one dot for obtaining the drum exposure potential of −200 V permitting the progression of the solid black density of 1.4 or above are shown in FIG. 13. FIG. 13 shows the reference emission time per one dot in the range of the image bearing member usage of 0 to 121200. The image bearing member usage (drum usage) is not the number of fed sheet as it is but is the above-described drum usage (W).

The solid black density progression and the line width progression are examined in an actual sheet feeding test by using the reference emission time, providing the resultant solid black density of not less than 1.4, shown in FIG. 13. In this sheet feeding test, six low consumption modes 1 to 6 are set as shown in FIG. 14. More specifically, the six low consumption modes 1 to 6 correspond to a drum usage (image bearing member usage) of 0, 37750 (corr. to the number of fed sheets of 5000 sheets), 75500 (corr. to 10000 sheets), 113250 (corr. to 15000 sheets), 15100 (corr. to 20000 sheets), and 181200 (corr. to 25000 sheets), respectively. The reference emission time is switched at timing such that the drum usage (W) reaches the respective levels. The relationship between the low consumption modes, the drum usage levels, and the reference emission times are shown in FIG. 14.

Figure 15:
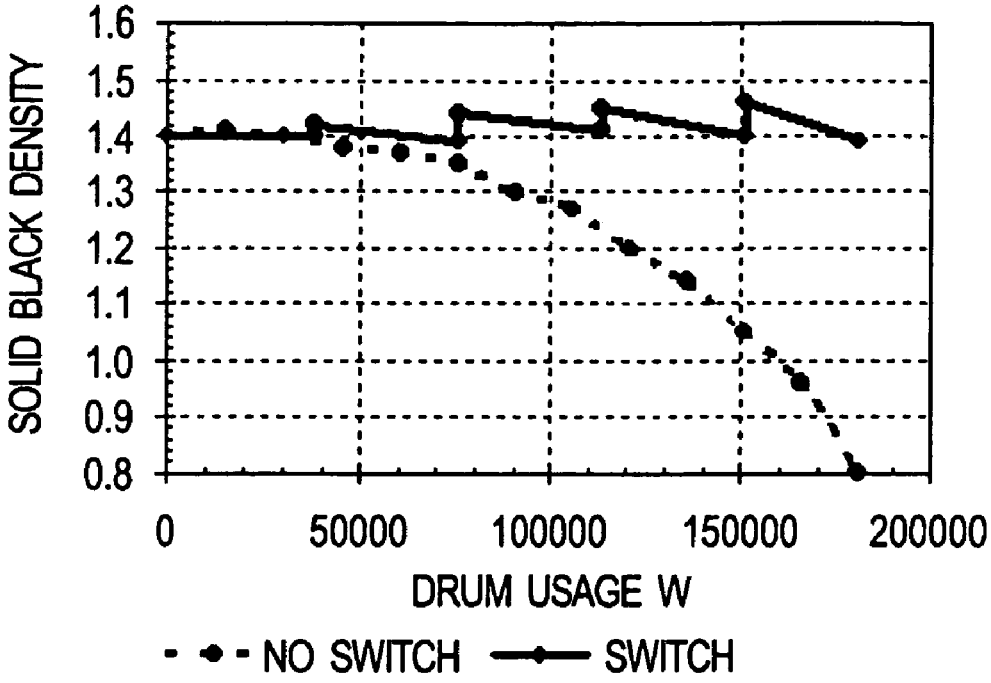
FIGS. 15(*a*) and 15(*b*) are graphs each showing an effect according to Embodiment 1.
Figure 15:
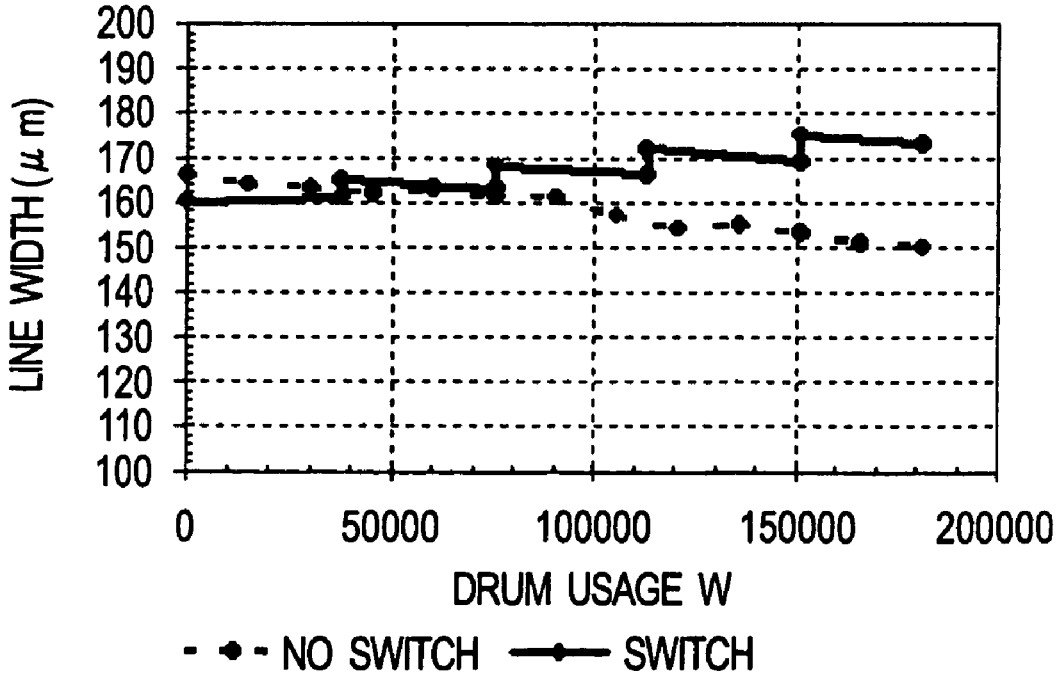

As a result, as shown in FIG. 15(*a*), the solid black image exhibits a stable image density through the sheet feeding test (with respect to the number of fed sheets). With respect to the line width as shown in FIG. 15(*b*), it is possible to ensure a substantially stable progression although the line width is increased in the latter stage.

Further, the threshold information obtained in this embodiment is stored in the storing device mounted to the cartridge. For example, when the sheet feeding test is performed on the same condition, the measuring speed of the photosensitive layer varies depending on characteristics of other constituted elements in some cases. In such cases, if control is effected by using the threshold information stored in advance in ROM (not shown) in the main assembly CPU, the threshold information cannot be changed for each cartridge, so that it becomes impossible to effect a desired correction depending on the drum usage. On the other hand, if the threshold information is stored in the cartridge storing device, by storing optimum threshold information for a constitutional element of the cartridge, it becomes possible to effect optimum control which meets the wearing speed change of the photosensitive layer depending on the individual cartridge characteristic.

Figures 16, 16A:
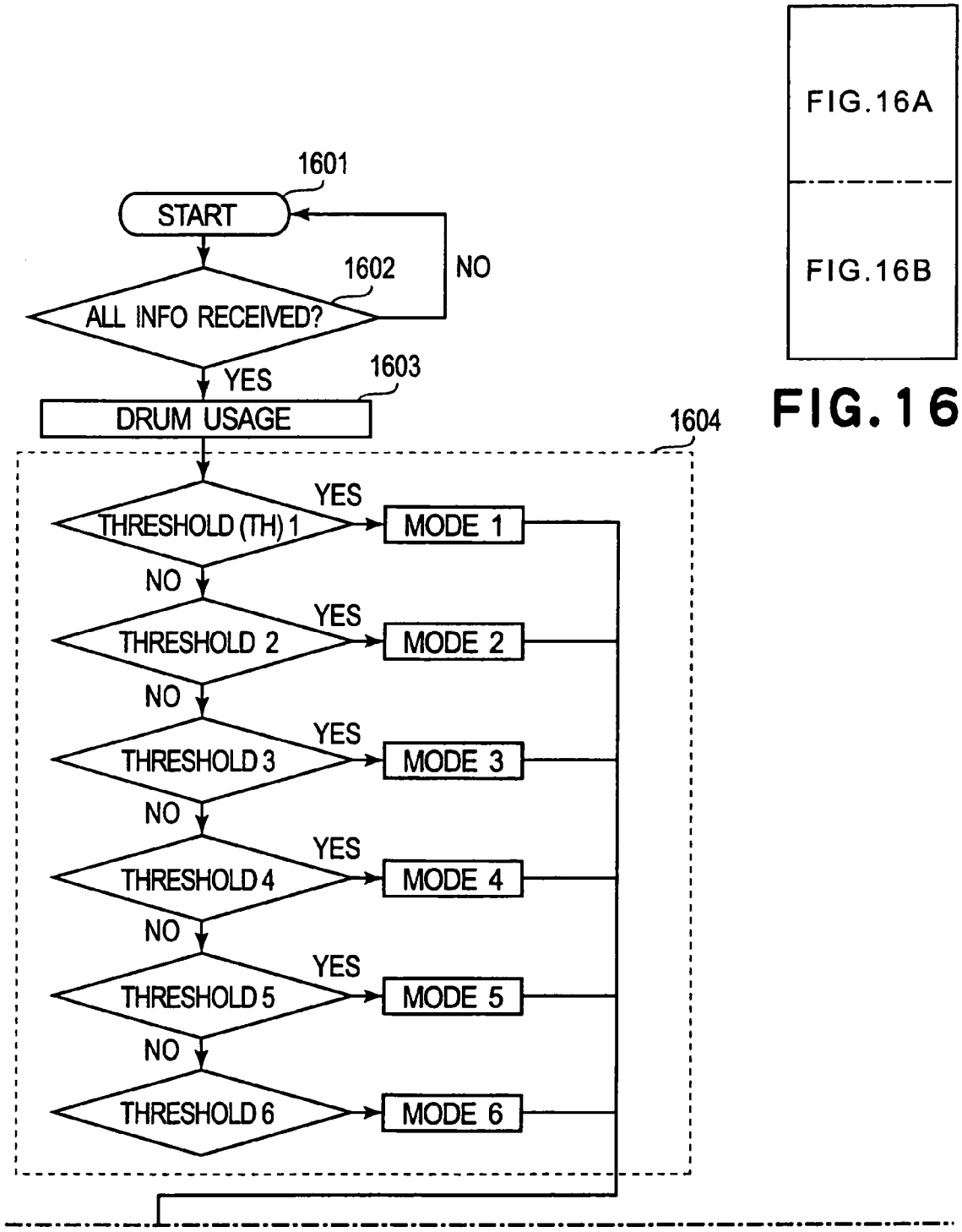
FIG. 16 illustrates the relationship between FIGS. 16(*a*) and 16(*b*), and FIGS. 16(*a*) and 16(*b*) are flow charts regarding control in Embodiment 1.
Figure 16B:
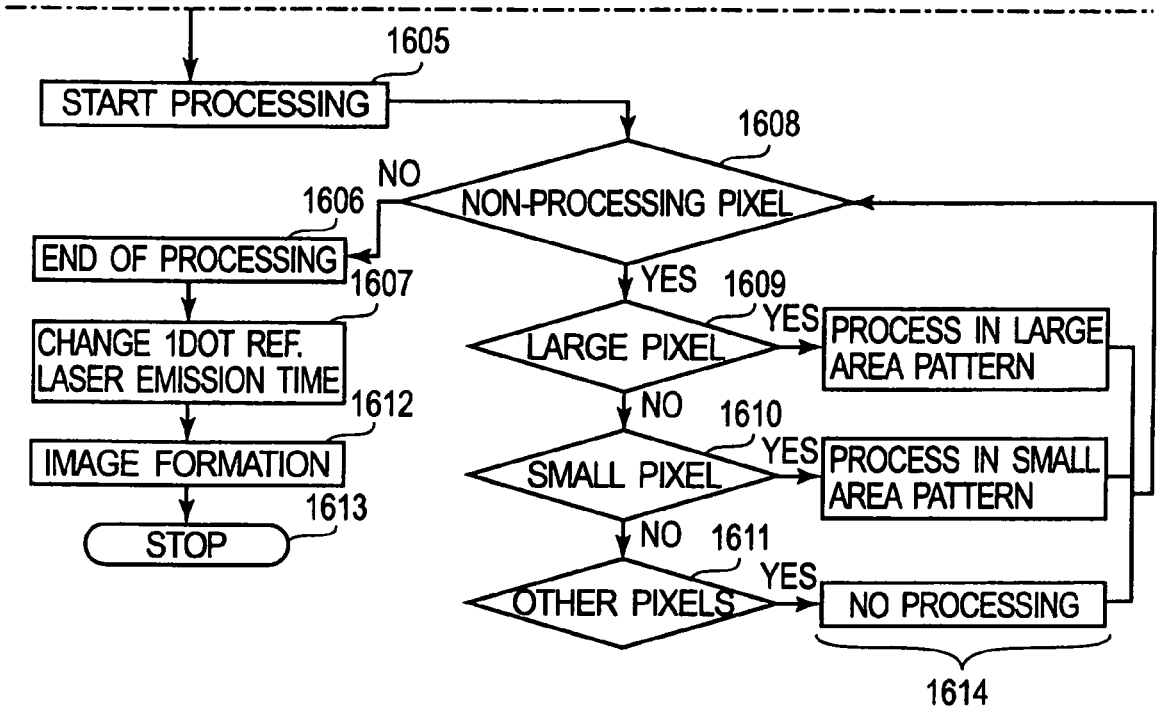

A flow of control in the low toner consumption mode in this embodiment will be described with reference to FIGS. 1, 14 and 16.

Together with a printing instruction, image information is sent from a computer or the like connected to a printer, whereby control in the printer is started (1601).

After the CPU 103 makes judgment as to whether all the image information is received (1602), the IO controller 104 needs threshold information from the storing device mounted to the cartridge. The CPU 103 compares a drum usage with threshold information to select a low consumption mode corresponding to the threshold information of the drum usage shown in FIG. 14 (1604). After the selection of the low consumption mode, the image processing (1605) is effected. Then, the image processing (1614) by the image processing controller 105 is effected in corresponding with a concentrated pixel determined from a concentrated pixel having a large area (1609), a concentrated pixel having a small area (1610), and other pixels, such as blank dots (1611). Thereafter, judgment by the CPU 103 is made as to whether there is an unprocessed image with respect to the resultant image information (1608). When completion of the image processing is confirmed (1606), image formation is effected. When the image formation is effected, a signal, for providing instructions to change the laser emission time, corresponding to a selected low consumption mode is outputted from the CPU 103 to the laser drive controller 106 to change the referential laser emission time per one dot depending on the threshold information of the drum usage (1607) thereby to expose the photosensitive image bearing member to laser light, thus effecting image formation (1612).

Thereafter, completion processing is performed to complete all the printing operations (1613).

As described above, by changing the laser emission time per the reference emission time for one dot of the concentrated pixel on the basis of the amount of usage of drum usage (the number of fed sheets) for the cartridge to effect control such that the exposure potential on the photosensitive drum is kept constant irrespective of the drum usage (the number of fed sheets), it becomes possible to effect such a low toner consumption mode which can decrease the toner consumption amount as low as possible, irrespective of a change in drum thickness due to drum use, to stabilize image qualities.

In this embodiment, such a control that a change ratio of the laser emission time to the reference emission time per one dot of the large area concentrated pixel such as a solid black image and a change ratio of the laser emission time to the reference emission time per one dot of the small area concentrated pixel are respectively set to a constant value irrespective of the number of fed sheets (drum usage).

In this embodiment, 6 types of low consumption modes to be switched are used but it is also possible to increase appropriately the number of types of low consumption modes to effectively provide stable image qualities.

Further, the image processing is performed in each low consumption mode by classifying the concentrated pixel into those having a small area and a large area. However, it is also possible to effect further detailed classification by performing analysis more specifically.

In this embodiment, with respect to a frame portion of the concentrated pixel area, it is effective to add a sequence such that an operation for reducing the toner consumption amount is not performed.

In the present invention, conditions including the process speed, the resolution, the laser emission time, the drum usage, its calculated equation, the contribution ratio with respect to the photosensitive layer thickness used in the calculation equation, the charging bias voltage application time, and the developing bias voltage application time are not limited to those employed in this embodiment.

Embodiment 2

In Embodiment 1, by changing the referential laser emission time per one dot depending on the drum usage, it became possible to provide a low consumption mode in which image qualities are stable. Further, in Embodiment 1, it became possible to keep the solid black image density at a value of not less than 1.4 irrespective of the drum usage but there is a tendency such that the line width (progression) is increased with the drum usage.

Further, in the case of increased line width, when many line images are used or the concentrated pixel area determined as the line image is concentrated at a relatively narrow area, attention of control in Embodiment 1 is directed to the solid black image. As a result, there is a possibility that respective images, which are essentially isolated with each other, are connected with each other to cause image collapse.

Accordingly, in this embodiment, the referential laser emission time per one dot 701 (FIG. 7) is kept constant but, the change ratio of the laser emission time to the reference emission time for the large area concentrated pixel area such as the solid black image and the change ratio of the laser emission time to the reference emission time for the small area concentrated pixel area such as the line width are set to be different values and are changed depending on the drum usage (the number of fed sheets).

The laser emission time per the appropriate reference emission time for the large area concentrated pixel area such as the solid black image has already been described and obtained in Embodiment 1, so that explanation thereof is omitted in this embodiment. Similarly, the control of the image forming apparatus and the explanation of the process cartridge (FIG. 1), explanation of outline of the image processing (FIG. 4), explanation of the image processing method, and explanation of the calculation of the photosensitive drum usage are identical to those in Embodiment 1, thus being omitted.

In this embodiment, an appropriate laser emission time for the small area concentrated pixel area such as the line image is obtained. As the small area concentrated pixel area, a 4 dot-wide line image is used similarly as in Embodiment 1. In order to obtain stable image qualities in the 4 dot-wide line image, it is necessary to ensure a line width of not less than 165 μm. Further, it is necessary to provide an exposure potential on the photosensitive drum of not less than −180 V in order to obtain the 4 dot-wide line image having the line width of not less than 165 μm. Accordingly, in this embodiment, through the sheet feeding test (the number of fed sheets), the laser emission time providing the drum exposure potential of not less than −180 V is measured every 5000 sheets. As a result, the laser emission time for obtaining the drum exposure potential of −180 V providing the line width progression in the range of not less than 165 μm is as shown in FIG. 17.

By using the laser emission time (per the reference emission time) for providing the line width of not less than 165 μm shown in FIG. 17, the line width progression in the sheet feeding test is evaluated. The change ratio (83%: 32 nsec) of the laser emission time to the reference emission time for satisfying the line width of not less than 165 μm at a drum usage value W=75500 (10000 sheets) is switched at time when the drum usage value W is 37750 (5000 sheets). Further, the correspondence between the number of feed sheets for switching and the laser emission time is shown in FIG. 18 together with the laser emission time corresponding to the drum usage in the solid black image obtained in Embodiment 1.

Figure 19:
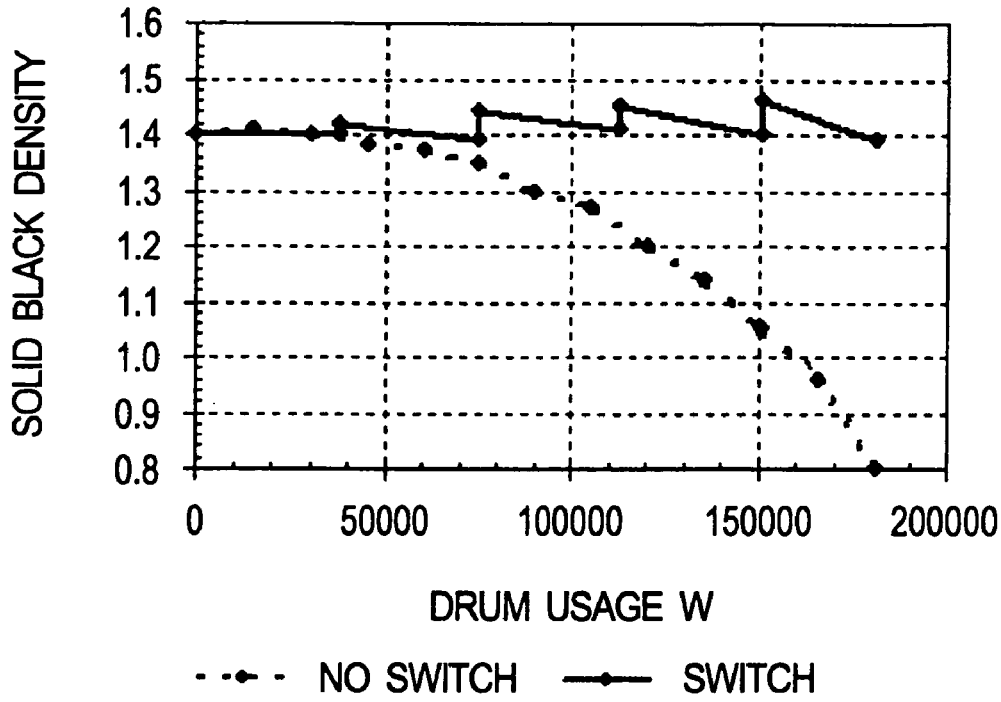
FIGS. 19(*a*) and 19(*b*) are graphs each showing an effect according to Embodiment 2.
Figure 19:
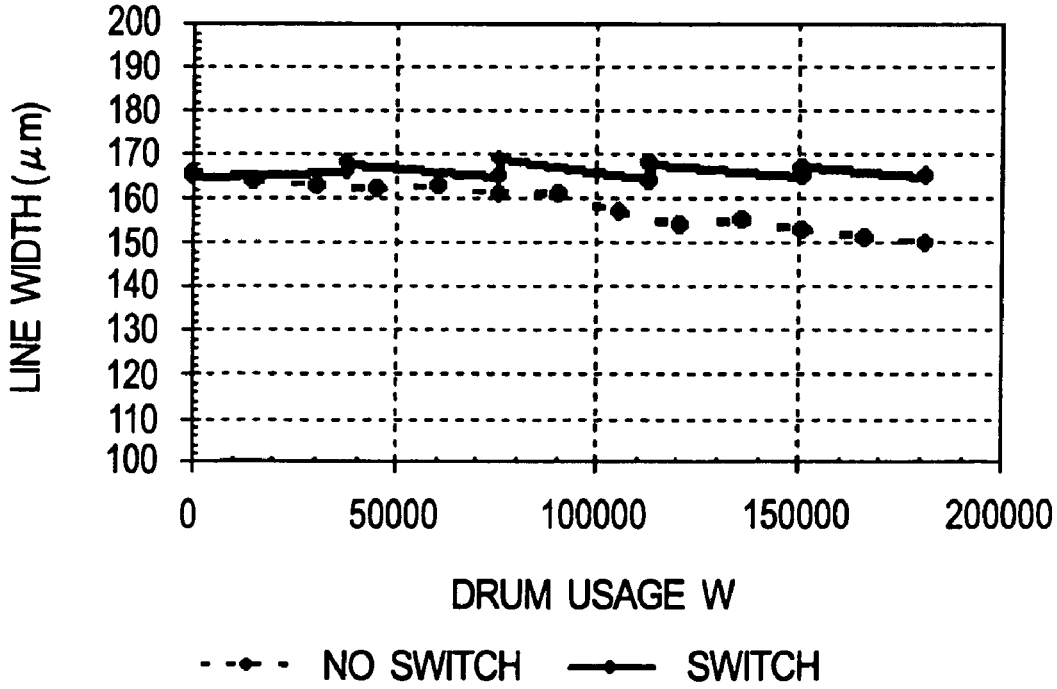

As a result, as shown in FIGS. 19(*a*) and 19(*b*), by effecting switching, it became possible to obtain satisfactory stable image qualities, irrespective of the drum usage, in terms of the solid black image density progression and the line image density progression.

Further, also in this embodiment, storage of threshold information in the storing device mounted to the cartridge is effective as described in Embodiment 1.

Figure 20:
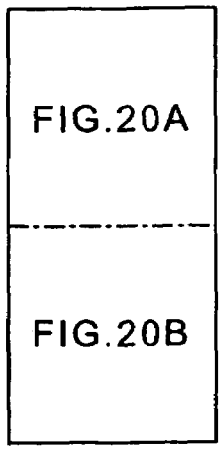
FIG. 20 illustrates the relationship between FIGS. 20(*a*) and 20(*b*), and FIGS. 20(*a*) and 20(*b*) are flow charts regarding control in Embodiment 2.
Figure 20A:
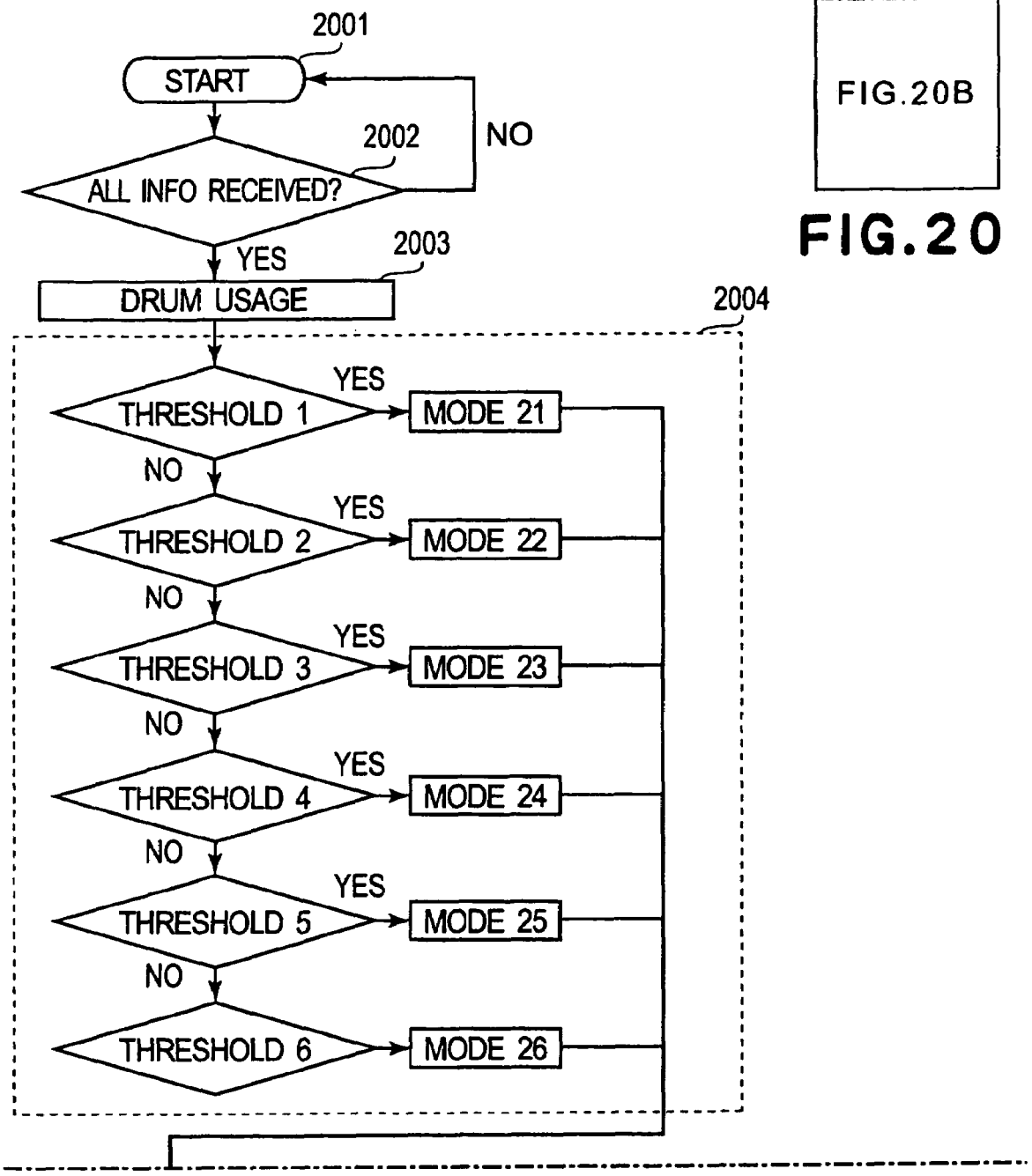
Figure 20B:
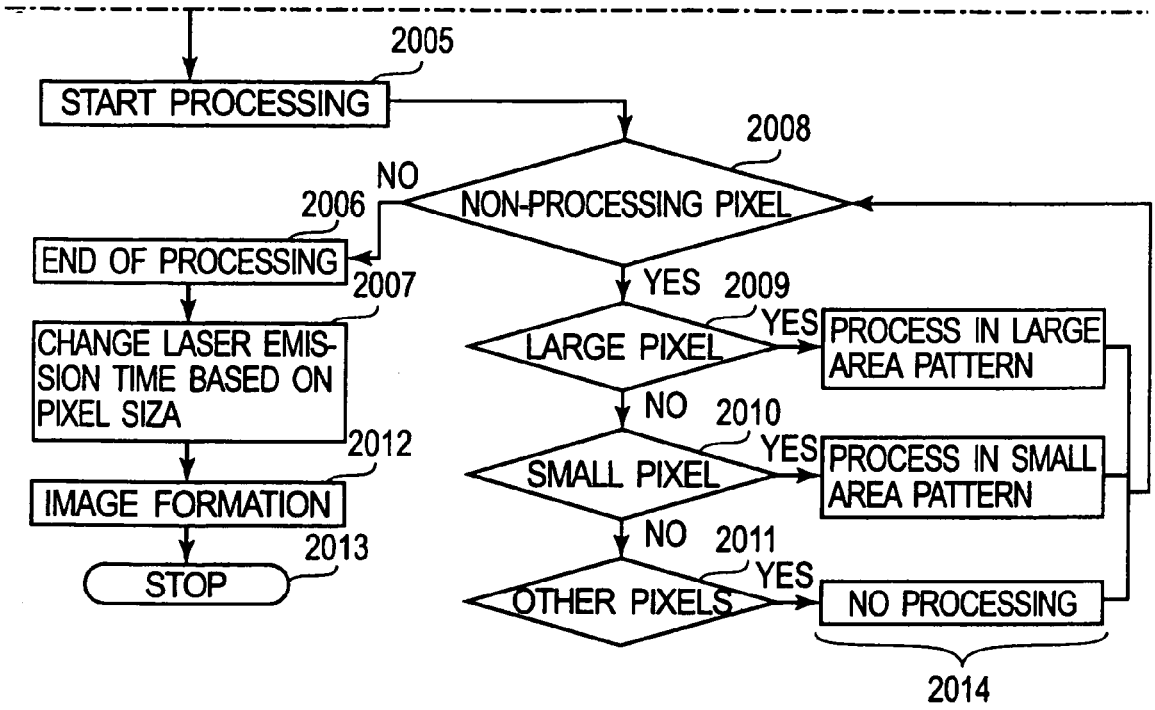

A flow of control in the low toner consumption mode in this embodiment will be described with reference to FIGS. 1, 18 and 20.

Together with a printing instruction, image information (image signal) is sent from a computer or the like connected to a printer, whereby control in the printer is started (2001).

After the CPU 103 makes Judgment as to whether all the image information is received (2002), the IO controller 104 needs threshold information from the storing device mounted to the cartridge. The CPU 103 compares a drum usage with threshold information to select a low consumption mode corresponding to the threshold information of the drum usage shown in FIG. 18 (2004). After the selection of the low consumption mode, the image processing (2005) is effected. Then, the image processing (2014) by the image processing controller 105 is effected in corresponding with a concentrated pixel determined from a concentrated pixel having a large area (2009), a concentrated pixel having a small area (2010), and other pixels, such as blank dots (2011). Thereafter, judgment by the CPU 103 is made as to whether there is an unprocessed image with respect to the resultant image information (2008). When completion of the image processing is confirmed (2006), image formation is effected. When the image formation is effected, a signal, for providing instructions to change the laser emission time, corresponding to a selected low consumption mode is outputted from the CPU 103 to the laser drive controller 106 to change the referential laser emission time per one dot depending on the threshold information of the drum usage (2007) thereby to expose the photosensitive image bearing member to laser light, thus effecting image formation (2008).

Thereafter, completion processing is performed to complete all the printing operations (2029).

As described above, by changing the change ratios in such a manner that the change ratio of the laser emission time to the reference emission time per one dot of the large area concentrated pixel such as a solid black image and the change ratio of the laser emission time to the reference emission time per one dot of the small area concentrated pixel are set be different from each other depending on the number of fed sheets (drum usage), it becomes possible to effect such a low toner consumption mode which can decrease the toner consumption amount as low as possible, irrespective of a change in drum thickness due to drum use, to stabilize image qualities.

In this embodiment, 6 types of low consumption modes to be switched are used but it is also possible to increase appropriately the number of types of low consumption modes to effectively provide stable image qualities.

Further, the image processing is performed in each low consumption mode by classifying the concentrated pixel into those having a small area and a large area. However, it is also possible to effect further detailed classification by performing analysis more specifically.

In this embodiment, with respect to a frame portion of the concentrated pixel area, it is effective to add a sequence such that an operation for reducing the toner consumption amount is not performed.

In the present invention, conditions including the process speed, the resolution, the laser emission time, the drum usage, its calculated equation, the contribution ratio with respect to the photosensitive layer thickness used in the calculation equation, the charging bias voltage application time, and the developing bias voltage application time are not limited to those employed in this embodiment.

The storing device mounted to the cartridge used in Embodiments 1 and 2 will be described more specifically with reference to FIG. 24 which shows a conceptual diagram of a storing area (region) 2801 of the storing device used in this embodiment.

Figure 24:
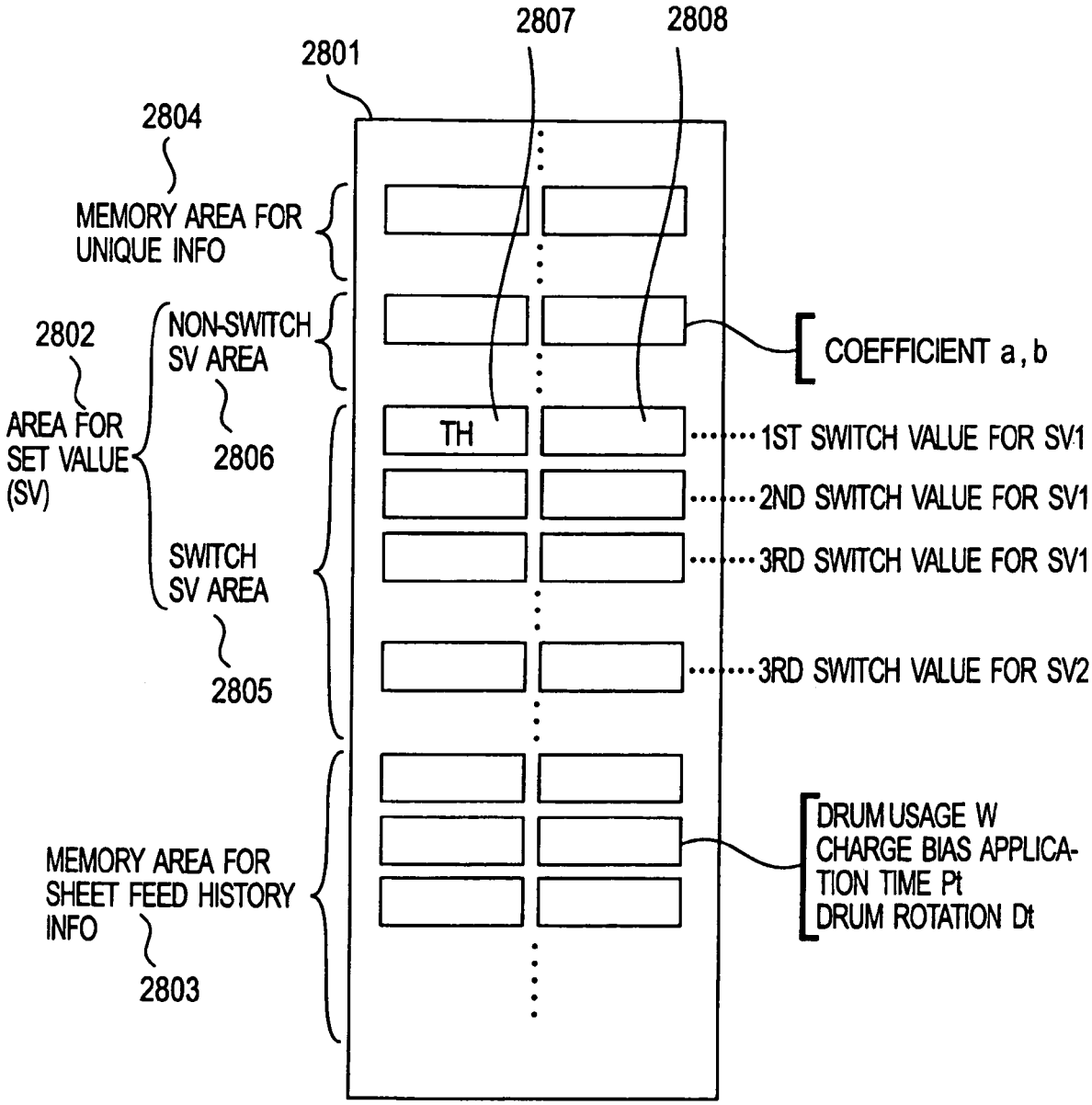
FIG. 24 is a schematic view showing storing areas in a storing device according to the present invention.

Referring to FIG. 24, the storing area 2801 may, e.g., be divided into an area 2802 in which process set values necessary for image formation are stored, an area 2803 for storing sheet feed history information which increases depending on sheet feeding operation, and an area 2804 in which unique information (e.g., a serial No.) of the cartridge is stored.

The process set values stored in the area 2801 include those 2805 which are switched with use and those 2806 which are constant for some cartridges.

In the area of the process set values 2805, threshold values 2807, such as switching sheet number and the number of rotation, and switching process set values 2808 are stored.

Further, a sufficient storage area is ensured so that the area 2803 for storing data of the number of rotation of the photosensitive drum and the number of fed sheets, generated by the use of the cartridge, can sufficiently store a maximum of available values.

The threshold information for the drum usage described in Embodiments 1 and 2 is stored in, the storing (memory) area 2802 of FIG. 24. At the timing when the drum usage reaches the threshold information, the control effecting the change in laser emission time is performed as described in Embodiments 1 and 2.

Incidentally, a value of the drum usage (W) calculated according to the above described equation is updated and stored in the area 2803 (FIG. 28) of the storing device, and the information thereon is spread out and compared with the threshold information stored in the area 2807 of the storing device. Based on the result thereof, the control described in Embodiments 1 and 2 may be effected at timing such that the drum usage reaches the threshold information.

Further, as data for calculating the drum usage (W), it is possible to use the charging bias application time Pt and the drum rotation time Dt, which are updated and stored in the area 2803 of the storing device, and coefficients (contribution ratios) a and b which are stored in the area 2804 of the storing device.

Incidentally, the laser emission time corresponding to the threshold information may be stored in the storage area for the process set values 2808 and used by reading it therefrom at a timing when the drum usage reaches the threshold information.

With respect to a manner of setting the storing areas of the storing device, it is not limited to that shown in FIG. 24. For example, it may appropriately modified so that a plurality of process set values are allotted to one piece of threshold information.

Embodiment 3

In Embodiment 2, the ratio of the laser emission time per the predetermined reference emission time 701 (FIG. 7) per one dot is changed depending on the amount of usage of the cartridge, whereby the drum exposure potential is controlled at a constant value irrespective of the number of fed sheets. On the other hand, in this embodiment, a light quantity of the laser light is changed depending on the drum usage of the toner cartridge to keep the drum exposure potential at a constant value irrespective of the number of fed sheets. The laser light quantity refers to laser luminous energy per unit area ($mJ/m^2$).

With respect to explanation of the image forming apparatus and the process cartridge (FIG. 1), explanation of outline of the image processing (FIG. 4), explanation of the image processing method (FIGS. 5-12), and explanation of calculation of the photosensitive drum usage, the explanations are identical to those in Embodiment 1, thus being omitted.

Also in this embodiment, the experimental equipments (the image forming apparatus and the cartridge) used in the above described experiment. Further, also in this embodiment, the solid black image density is particularly largely changed depending on the number of fed sheets (drum usage), so that attention is directed to the solid black image density to effect evaluation.

First, in this embodiment, for each of the numbers of the fed sheets, the laser light quantity providing the drum exposure potential of not less than −200 V at which the solid black image density is not less than 1.4 is measured every 5000 sheets. As a result, the laser light quantity for obtaining the drum exposure potential of −200 V providing the solid black density progression in the range of not less than 1.4 is as shown in FIG. 25.

By using the laser light quantity for obtaining the drum exposure potential of not less than −200 V required for providing the solid black density of not less than 1.4 shown in FIG. 25, the solid black density progression and the line width progression in the sheet feeding test are evaluated. The laser light quantity for satisfying the solid black density of not less than 1.4 at a drum usage value W=75500 (10000 sheets) is switched at time when the drum usage value W is 37750 (5000 sheets). Further, the correspondence between the number of feed sheets for switching and the laser light quantity is shown in FIG. 26.

Figure 27:
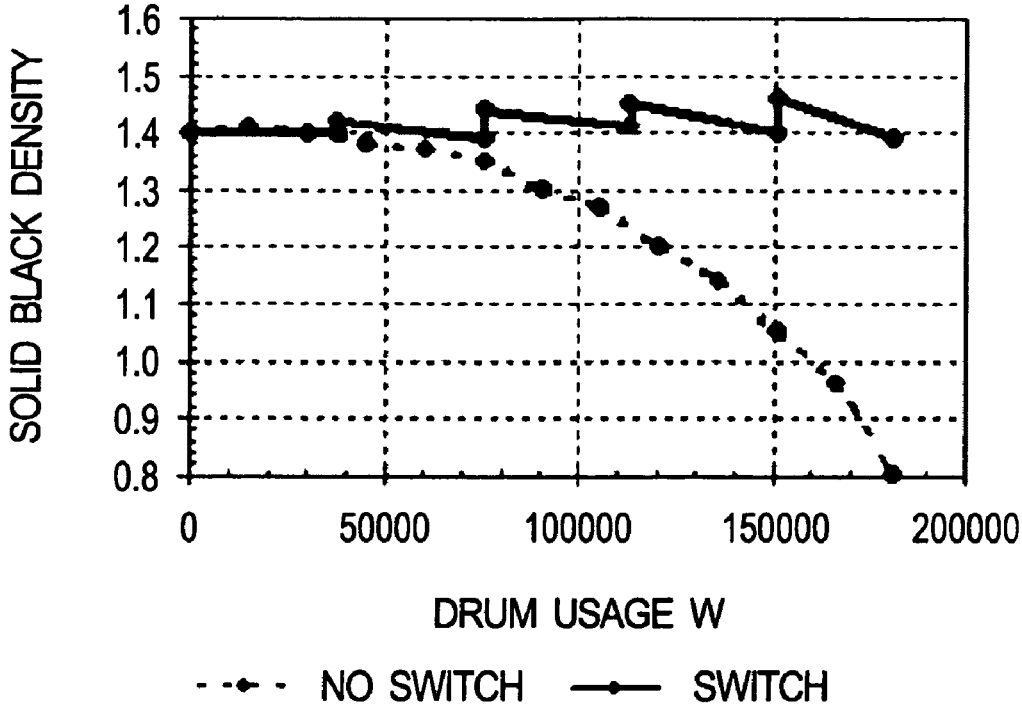
FIGS. 27(*a*) and 27(*b*) are graphs each showing an effect of switching of laser light quantities in Embodiment 3.
Figure 27:
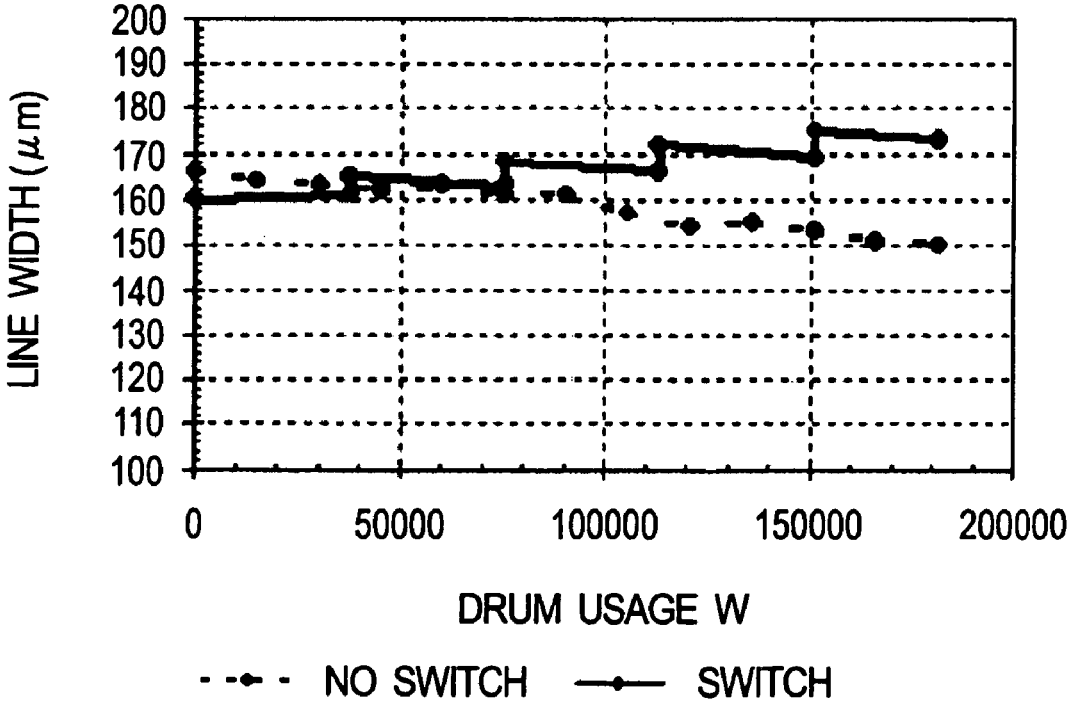

As a result, as shown in FIG. 27(*a*), the solid black image density can exhibit a stable value through the sheet feeding test.

With respect to the line image, as shown in FIG. 27(*b*), a stable line width progression can be obtained although an increase in line width is somewhat observed in the latter stage.

Figure 28:
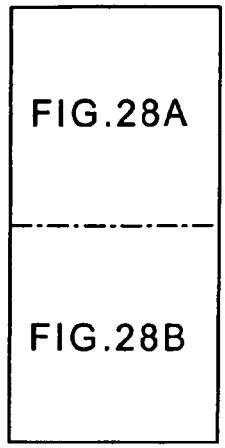
FIG. 28 shows the relationship between FIGS. 28(*a*) and 28(*b*), and FIGS. 28(*a*) and 28(*b*) are flow charts regarding control in Embodiment 3.
Figure 28A:
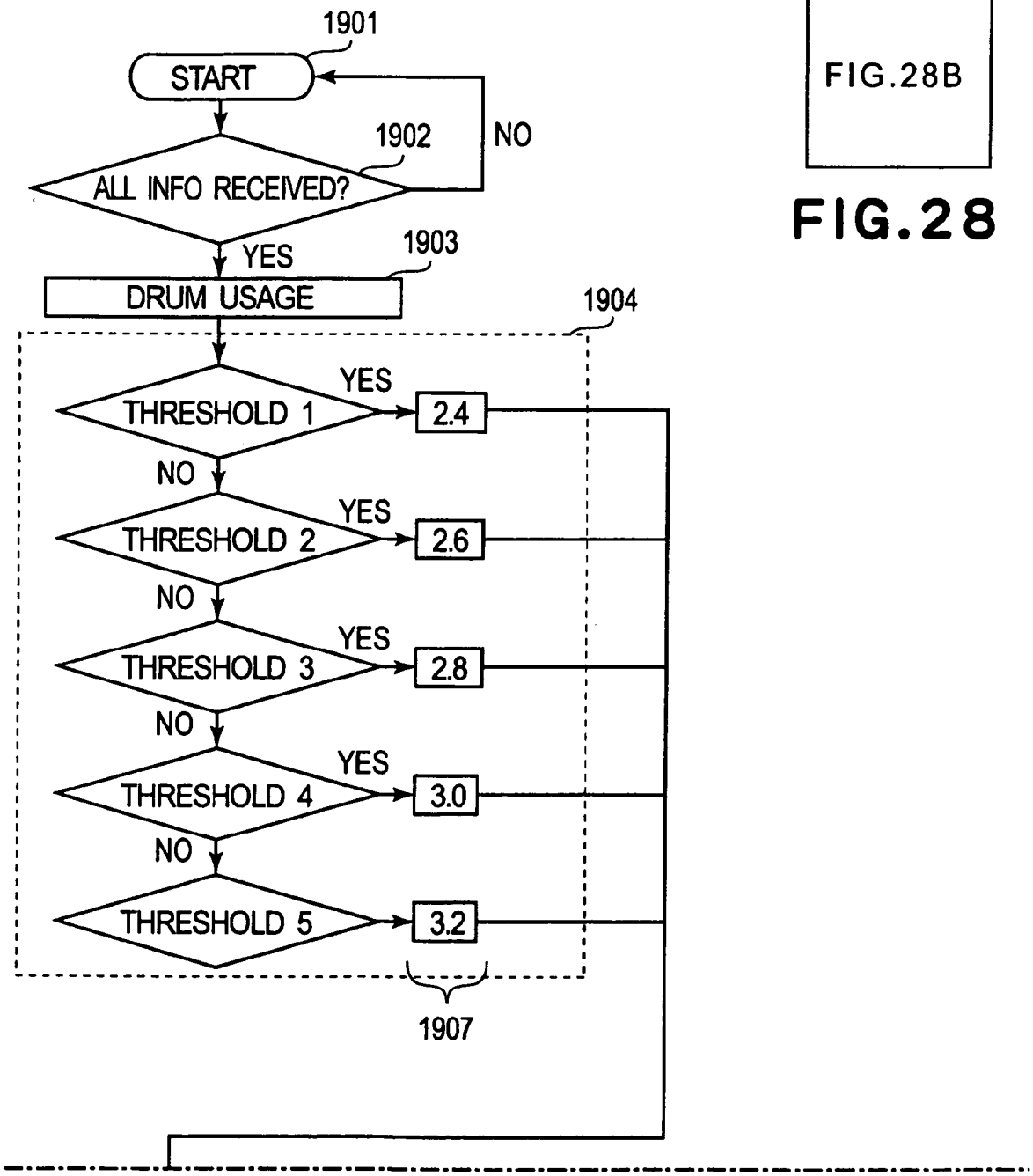
Figure 28B:
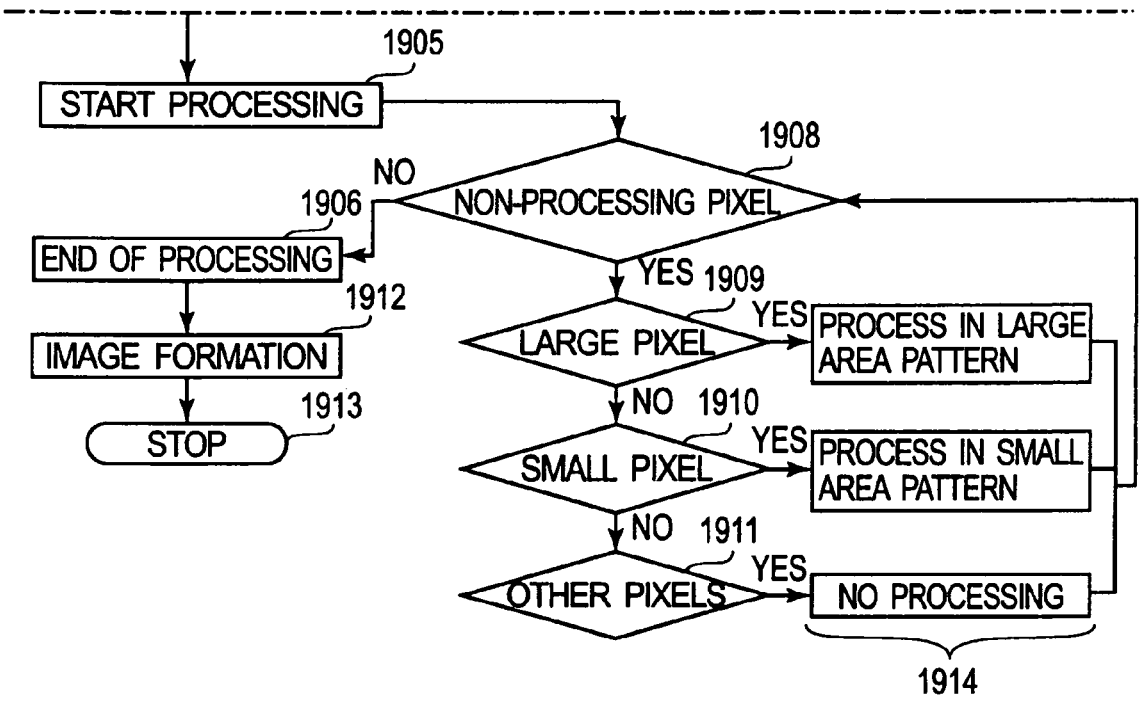

A flow of control in the low toner consumption mode in this embodiment will be described with reference to FIGS. 1, 26 and 28.

Together with a printing instruction, image information is sent from a computer or the like connected to a printer, whereby control in the printer is started (1901). After the CPU 103 makes Judgment as to whether all the image information is received (1902), the IO controller 104 reads threshold information from the storing device mounted to the cartridge. The CPU 103 compared a drum usage with the threshold information (1904) to select a laser light quantity corresponding to the threshold information of the drum usage shown in FIG. 26 (1907). After the selection of the laser light quantity, the image processing is effected by the image processing controller 105 (1906). Then, the image processing is effected (1914) in correspondence with a concentrated pixel area determined from a concentrated pixel area having a large area (1909), a concentrated pixel area having a small area (1910), and no printing pixel areas such as blank dots (1911). Thereafter, Judgment is made as to whether there is an unprocessed image with respect to the resultant image information (1908). When completion of the image processing is confirmed (1906), image formation is effected. When the image formation is effected, the photosensitive drum is exposed to laser light at the selected laser light quantity to perform image formation (1912). Thereafter, completion processing is performed to complete all the printing operations (1913).

In this embodiment, similarly as in Embodiments 1 and 2, the threshold information of the drum usage is stored in the cartridge storing device and control of changing the laser light quantity value as the image forming condition at timing when the drum usage reaches the threshold information.

The storing device has the same structure as that shown in FIG. 24. The threshold information of the drum usage is stored in the storage area 2807 in FIG. 24. Further, the laser light quantity corresponding to the threshold information may be stored in the storage area 2808.

Further, in this embodiment, similarly as in Embodiments 1 and 2, it is possible to effect the control performed in Embodiments 1 and 2 in such a manner that the drum usage W calculated from the above described calculation equation of the drum usage is updated and stored in the storage area 2803 of the storing device and its information is read out and compared with the threshold information stored in the storage area 2807 of the storing device to effect the control at timing when the drum usage reaches the threshold information.

Further, similarly as in Embodiments 1 and 2, the charging bias application time Pt and the drum rotation time Dt may be updated and stored in the storage area 2803 and the coefficients a and b may be stored in the storage area 2804 to be used for the calculation of the drum usage W.

As described above, by changing the laser light quantity per one dot of the concentrated pixel depending on the drum usage (the number of fed sheets) for the cartridge, it is possible to effect such a low toner consumption mode which can keep the change in exposure potential on the photosensitive member at a constant level on the basis of the drum usage and decrease the toner consumption amount as low as possible, irrespective of a change in drum thickness due to drum use, the stabilize image qualities.

In this embodiment, 5 types of each of the laser light quantities values and threshold values to be switched are used but it is also possible to increase appropriately the number of types of laser light quantity values to effectively provide stable image qualities.

Further, the image processing is performed in each low consumption mode by classifying the concentrated pixel into those having a small area and a large area. However, it is also possible to effect further detailed classification by performing analysis more specifically.

In this embodiment, with respect to a frame portion of the concentrated pixel area, it is effective to add a sequence such that an operation for reducing the toner consumption amount is not performed.

In the present invention, conditions including the process speed, the resolution, the laser emission time, the drum usage, its calculated equation, the contribution ratio with respect to the photosensitive layer thickness used in the calculation equation, the charging bias voltage application time, and the developing bias voltage application time are not limited to those employed in this embodiment.

Embodiment 4

In Embodiment 3, even in the case where the photosensitive layer is worn depending on the drum usage to change the exposure potential on the photosensitive drum, by changing a light quantity of the laser light depending on the drum usage of the toner cartridge and switching it so as to keep the drum exposure potential at a constant value, it became possible to provide a low consumption mode providing stable image qualities.

In this embodiment, depending on the drum usage, a developing bias voltage and a charging bias voltage are changed to keep a developing contrast at a constant value without changing a back contrast, whereby a low consumption mode stabilizing image qualities is provided.

With respect to explanation of the image forming apparatus and the process cartridge (FIG. 1), explanation of outline of the image processing (FIG. 4), explanation of the image processing method (FIGS. 5-12), and explanation of calculation of the photosensitive drum usage, the explanations are identical to those in Embodiment 1, thus being omitted.

Hereinbelow, this embodiment will be described.

In this embodiment, the low consumption mode and experiment conditions are identical to those described in Embodiment 1.

First, when a relationship between the drum usage and the developing contrast is examined, a DC component of the developing bias voltage is −450 V similarly as in Embodiment 1 described above. From FIG. 29, it is found that the developing contrast is 250 V at an initial stage of sheet feeding, i.e., at the drum usage W=0 but is lowered to about 100 V in the vicinity of the drum usage W=18000.

Accordingly, the DC component of the developing bias voltage is changed depending on the drum usage so that the developing contrast is always not less than 250 V. In this case, if only the DC component of the developing bias voltage is changed, it is possible to keep the developing contrast constant but a value of the back contrast with the drum exposure potential is decreased to cause developing fog in some cases. For this reason, a DC component of the charging bias voltage is also changed together with the DC component of the developing bias voltage.

Further, even in the case where the drum exposure potential is changed, the exposure potential on the photosensitive drum which is exposed to laser light from the scanner laser is to substantially changed.

Figures 29, 30:
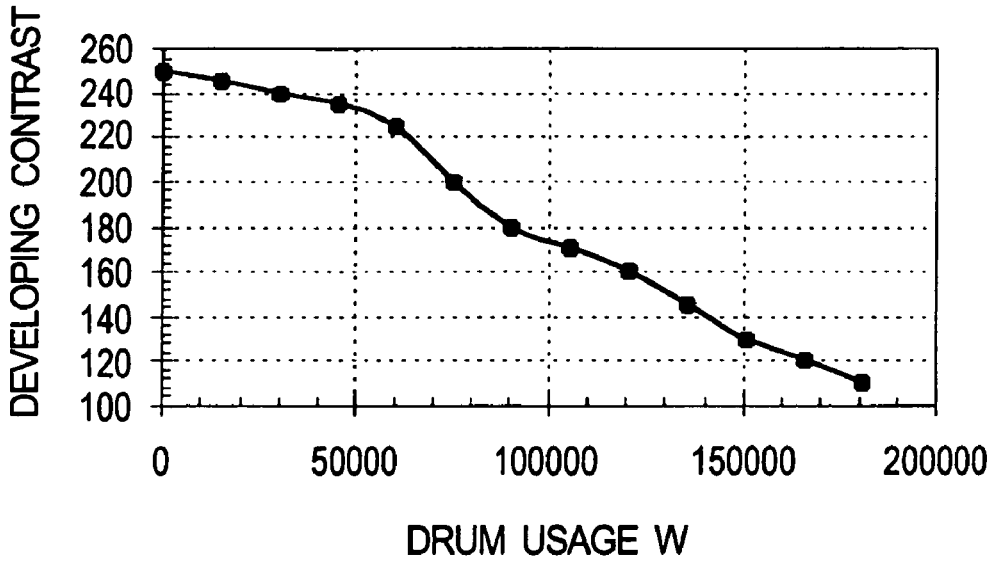
FIG. 29 is a graph showing a relationship between a drum usage W and a developing contrast in Embodiment 4.
FIG. 30 is a table showing a threshold value, a charging bias application condition, and a developing bias application condition in Embodiment 4.

The charging bias DC component and the developing bias DC component with respect to the respective drum usage values are shown in FIG. 30. By using FIG. 30, the density progression in the case of effecting the sheet feeding test will be described.

Figure 31:
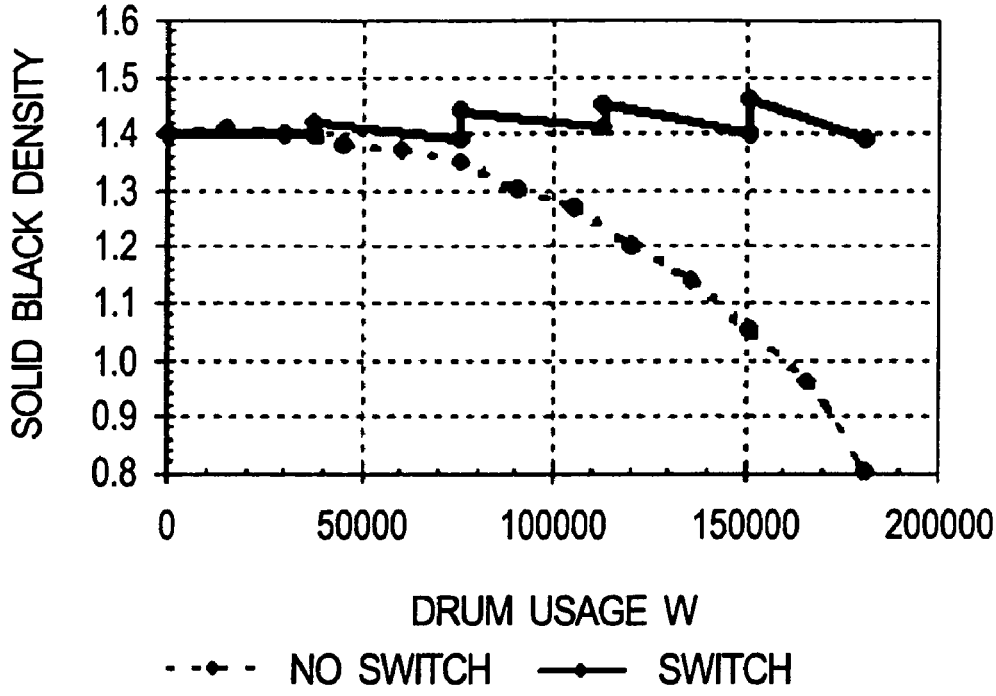
FIGS. 31(*a*) and 31(*b*) are graphs showing the solid black density progression and the line image progression. respectively.
Figure 31:
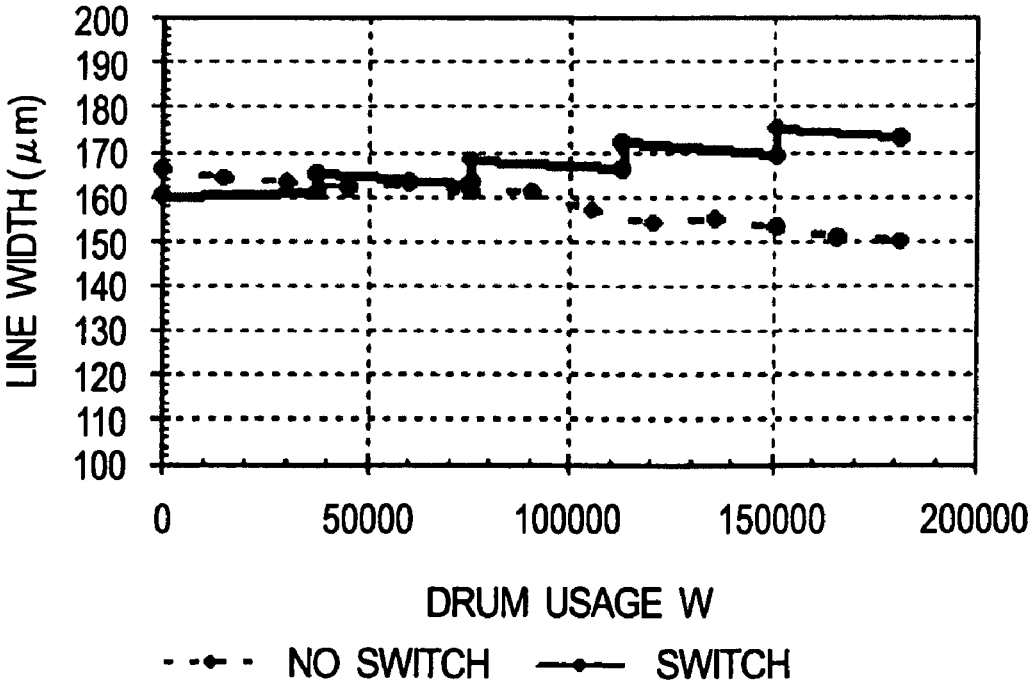

As a result shown in FIGS. 31(*a*) (solid black density) and 31(*b*) (line width), by switching the developing contrast so as to ensure a value of not less than 250 V while retaining the black contrast, the solid black density progression and the line image progression which have been lowered depending on the drum usage, can be stabilized to provide a stable image through the sheet feeding test.

Figure 32:
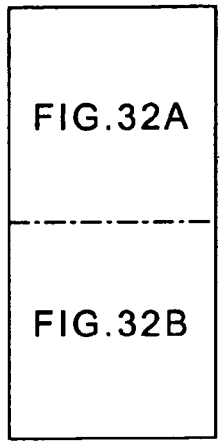
FIG. 32 shows the relationship between FIGS. 32(*a*) and 32(*b*), and FIGS. 32(*a*) and 32(*b*) are flow charts regarding control in Embodiment 4.
Figure 32A:
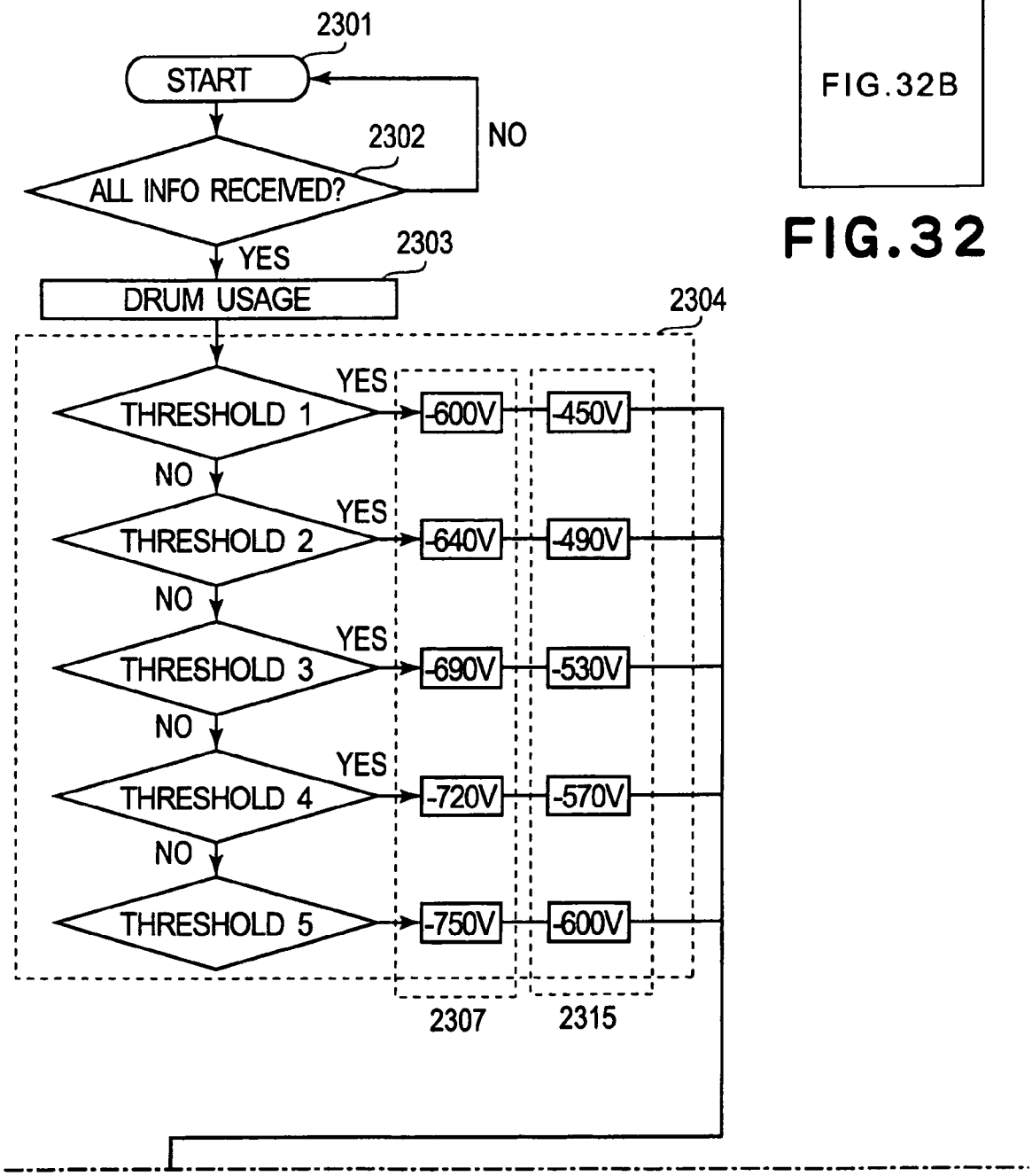
Figure 32B:
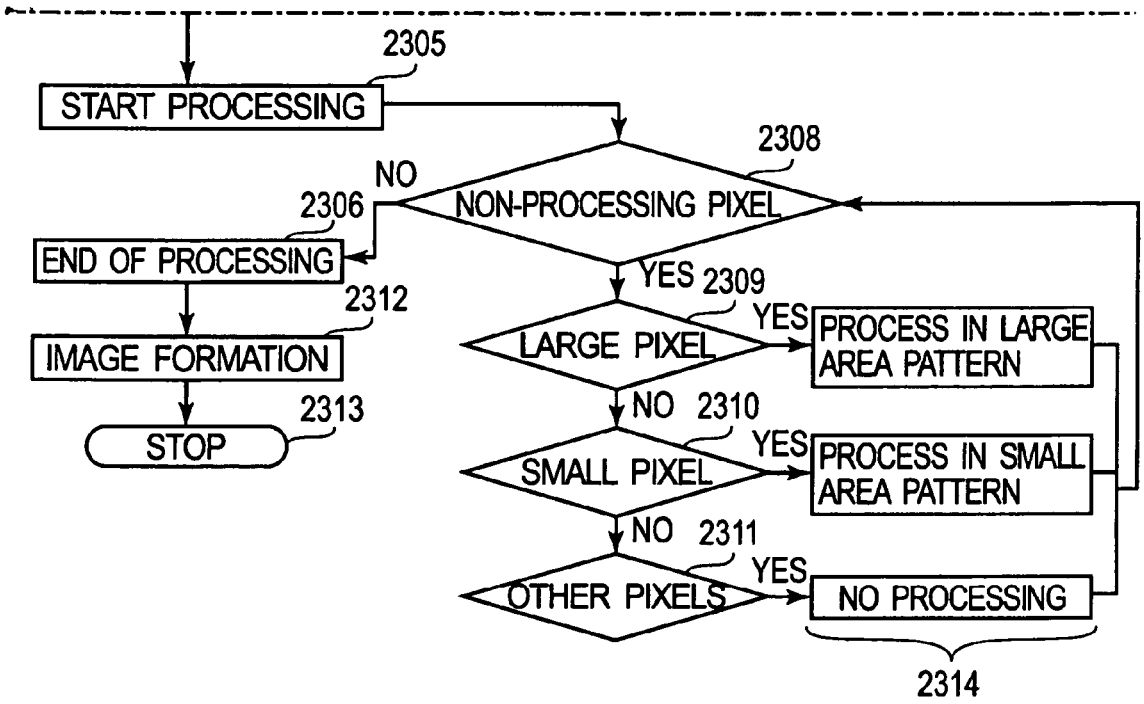

A flow of control in the low toner consumption mode in this embodiment will be described with reference to FIGS. 1, 30 and 32.

Together with a printing instruction, image information is sent from a computer or the like connected to a printer, whereby control in the printer is started (2301). After the CPU 103 makes Judgment as to whether all the image information is received (2302), the IO controller 104 reads threshold information from the storing device mounted to the cartridge. The CPU 103 compared a drum usage with the threshold information (2304) to select a developing bias voltage (2315) and a charging bias voltage (2307) which correspond to the threshold information of the drum usage shown in FIG. 30 (2307). After the selection, the image processing is effected by the image processing controller 105 (2306). Then, the image processing is effected (2314) in correspondence with a concentrated pixel area determined from a concentrated pixel area having a large area (2309), a concentrated pixel area having a small area (2310), and no printing pixel areas such as blank dots (2311). Thereafter, judgment is made as to whether there is an unprocessed image with respect to the resultant image information (2308). When completion of the image processing is confirmed (2306), image formation is effected. When the image formation is effected, the photosensitive drum is charged by the developing bias voltage selected depending on the drum usage and is exposed to laser light. By the developing contrast created by the developing bias voltage and the charging bias voltage selected depending on the drum usage, image formation is performed (2312). Thereafter, completion processing is performed to complete all the printing operations (2313).

In this embodiment, similarly as in Embodiments 1 to 3, the threshold information of the drum usage is stored in the cartridge storing device and control of changing the laser light quantity value as the image forming condition at timing when the drum usage reaches the threshold information.

The storing device has the same structure as that shown in FIG. 24. The threshold information of the drum usage is stored in the storage area 2807 in FIG. 24. Further, the values of the developing and charging bias voltages corresponding to the threshold information may be stored in the storage area 2808.

Further, in this embodiment, similarly as in Embodiments 1 and 2, it is possible to effect the control performed in Embodiments 1 and 2 in such a manner that the drum usage W calculated from the above described calculation equation of the drum usage is updated and stored in the storage area 2803 of the storing device and its information is read out and compared with the threshold information stored in the storage area 2807 of the storing device to effect the control at timing when the drum usage reaches the threshold information.

Further, similarly as in Embodiments 1 and 2, the charging bias application time Pt and the drum rotation time Dt may be updated and stored in the storage area 2803 and the coefficients a and b may be stored in the storage area 2804 to be used for the calculation of the drum usage W.

As described above, with respect to the drum exposure potential changing depending on the drum usage (the number of fed sheets), the developing bias voltage is changed to keep the developing contrast constant. Further, the developing bias voltage is changed in order to make the developing contrast constant and at the same time, the charging bias voltage is similarly changed to change the drum exposure potential, whereby the back contrast is kept constant and the developing fog is not caused to occur. As a result, it is possible to effect the low toner consumption mode capable of retaining a stable image.

In this embodiment, the respective values of the charging and developing bias voltages described above are not limited to the above described values.

Further, the threshold values, the switching timing, and the number of switching are also not limited to those described above.

The above described control methods in Embodiments 1 to 4 are directed to the low toner consumption mode, thus being not applicable to an ordinary image formation mode.

In the present invention, other than the above-described control for reducing the change in exposure potential on the photosensitive member (photosensitive drum) in the low toner consumption mode described in Embodiments 1 to 4, such a control that charging and developing conditions are switched depending on the drum usage in order to retain image qualities in the ordinary image formation mode and in the low toner consumption mode. In this case, threshold values different from those for the drum usage employed in Embodiments 1 to 4 are used for switching the charging and developing conditions.

While the invention has been described with reference to the structures disclosed herein, it is not confined to the details set forth and this application is intended to cover such modifications or changes as may come within the purposes of the improvements or the scope of the following claims.

INDUSTRIAL APPLICABILITY

As described hereinabove, according to the present invention, by changing an image forming condition depending on an amount of usage of image bearing member (drum usage), it becomes possible to retain a stable image to decrease an amount of consumption of developer, irrespective of the drum usage.

Further, by changing an image forming condition depending on an amount of usage of image bearing member and discrimination results of the discrimination means for discriminating the size of the concentrated pixel area to be formed, it becomes possible to retain a stable image to decrease an amount of consumption of developer, irrespective of the drum usage.

Further, by changing the developing condition of the developing member and the charging condition of the charging member as an image forming condition depending on an amount of usage of image bearing member, it becomes possible to retain a stable image to decrease an amount of consumption of developer, irrespective of the drum usage.

The invention claimed is:

1. An image forming apparatus operable in a first image formation mode for forming an image on an image bearing member by using developer under a first predetermined image forming condition and a second image formation mode for forming an image on an image bearing member by using developer under a second image forming condition which is different from the first predetermined image forming condition and is set so that an amount of consumption of developer with respect to an identical image in the second image formation mode is smaller than that in the first image formation mode, the apparatus comprising:

a storing device configured to store threshold information on an amount of usage of the image bearing member;

a controller configured to set said image forming apparatus in the first image formation mode or the second image formation mode; and an image processing controller configured to discriminate a size of a concentrated pixel area in image information when the second image formation mode is set, and to perform first and second image density lowering processes on image information representing pixel areas of different sizes, depending on the discriminated size of the pixel area, wherein in a state in which said controller is configured to set said image forming apparatus in the second image formation mode, an image density lowering process performed on the image information by said image processing controller is changed depending on the discrimination result of said image processing controller in such a manner that the first image density lowering process is performed so that image information representing pixels in pixel areas of a first size of the image to be formed is a first image density, and the second image density lowering process is performed so that image information representing pixels in pixel areas of a second size of the image to be formed is a second image density lower than the first image density; and wherein said controller sets the second image forming condition on the basis of the discrimination result of said image processing controller and the threshold information stored in said storing device when the amount of usage of the image bearing member reaches a predetermined threshold represented by the threshold information.

2. An apparatus according to claim 1, wherein said controller sets the second image forming condition depending on whether the concentrated pixel area is larger or smaller than a predetermined size.

3. An apparatus according to claim 1, wherein a plurality of thresholds represented by the threshold information on the amount of usage of the image bearing member is predetermined threshold information, and stored in said storing device, and wherein said controller sets the second image forming condition when the amount of usage of the image bearing member reaches a predetermined threshold of the predetermined threshold information, each of the thresholds represented by the predetermined threshold information being stored in said storing device.

4. An apparatus according to claim 1, wherein said image forming apparatus further comprises an exposure device configured to expose the image bearing member, wherein the second image formation condition includes an exposure operation condition on the exposure device.

5. An apparatus according to claim 4, wherein the exposure operation condition is an exposure time or luminous energy of said exposure device.

6. An apparatus according to claim 1, wherein said apparatus includes a charging member configured and positioned to electrically charge the image bearing member and a developing member configured and positioned to supply the developer to the image bearing member, and wherein the second image forming condition comprises a charging condition of the charging member and a developing condition of the developing member.

7. An apparatus according to claim 6, wherein the charging condition is a bias voltage applied to the charging member and the developing condition is a bias voltage applied to the developing member.

8. An apparatus according to claim 1, wherein the image bearing member and said storing device are integrally supported to form a cartridge which is detachably mountable to the image forming apparatus.

9. An apparatus according to claim 8, wherein the cartridge further comprises the charging member or the developing member.

* * * * *